US007015902B2

(12) United States Patent
Nagai et al.

(10) Patent No.: US 7,015,902 B2
(45) Date of Patent: Mar. 21, 2006

(54) DISPLAY AND DISPLAY DRIVE CIRCUIT OR DISPLAY DRIVE METHOD

(75) Inventors: Yoshifumi Nagai, Anan (JP); Ryuhei Tsuji, Anan (JP)

(73) Assignee: Nichia Corporation, Tokushima (JP)

( * ) Notice: Subject to any disclaimer, the term of this patent is extended or adjusted under 35 U.S.C. 154(b) by 292 days.

(21) Appl. No.: 10/088,401

(22) PCT Filed: Jul. 27, 2001

(86) PCT No.: PCT/JP01/06515

§ 371 (c)(1),
(2), (4) Date: Jul. 22, 2002

(87) PCT Pub. No.: WO02/11116

PCT Pub. Date: Feb. 7, 2002

(65) Prior Publication Data

US 2002/0180719 A1 Dec. 5, 2002

(30) Foreign Application Priority Data

Jul. 28, 2000 (JP) ..... 2000-230095
Jul. 31, 2000 (JP) ..... 2000-230624

(51) Int. Cl.
*G09G 5/00* (2006.01)

(52) U.S. Cl. ..... 345/204; 345/98

(58) Field of Classification Search ..... 345/204, 345/205, 206, 30, 55, 80, 84, 87, 98, 100, 345/90
See application file for complete search history.

(56) References Cited

U.S. PATENT DOCUMENTS 5,815,136 A 9/1998 Ikeda et al.
6,118,425 A * 9/2000 Kudo et al. ..... 345/100

FOREIGN PATENT DOCUMENTS

| | | |
|---|---|---|
| JP | 2-264995 | 10/1990 |
| JP | 8-236339 | 8/1994 |
| JP | 7-175446 | 7/1995 |
| JP | 8-23536 | 1/1996 |
| JP | 8-101668 | 4/1996 |
| JP | 8-223514 | 8/1996 |
| JP | 9-74551 | 3/1997 |

(Continued)

*Primary Examiner*—Henry N. Tran
*Assistant Examiner*—Jean Lesperance
(74) *Attorney, Agent, or Firm*—Wenderoth, Lind & Ponack, L.L.P.

(57) ABSTRACT

Each horizontal driving section and a driving control section of a display apparatus have a data communicating function. The driving control section has a first communicating section receiving data from an external device and a second communicating section communicating data with each horizontal driving section. The second communicating section adds individual identification information for identifying each horizontal driving section to the transferred data, and transfers the data in packet format. The horizontal driving section receives the data packet for it based on the identification information, and performs current driving for a display section. The driving control section adds the individual identification information to the control data to be transferred to each horizontal driving section corresponding to connecting form of the horizontal driving sections, and transfers the control data not concerned with connecting order of the horizontal driving sections. The horizontal driving section side performs a receiving process and lighting operation.

28 Claims, 22 Drawing Sheets

FOREIGN PATENT DOCUMENTS

| | | |
|---|---|---|
| JP | 9-247592 | 9/1997 |
| JP | 10-333631 | 12/1998 |
| JP | 11-126047 | 5/1999 |
| JP | 11-212527 | 8/1999 |
| JP | 2000-250465 | 9/2000 |
| WO | 96/10244 | 4/1996 |

* cited by examiner (a)

(b)

(c)

(a)

(b)

(a) S−Shaped Connection (b) Z−Shaped Connection

| | ID REGISTER |
|---|---|
| Driver1 | ID1 |
| Driver2 | ID2 |
| Driver3 | ID3 |
| Driver4 | ID4 |
| Driver5 | ID8 |
| Driver6 | ID7 |
| Driver7 | ID6 |
| Driver8 | ID5 |
| Driver9 | ID9 |
| Driver10 | ID10 |
| Driver11 | ID11 |
| Driver12 | ID12 |
| Driver13 | ID16 |
| Driver14 | ID15 |
| Driver15 | ID14 |
| Driver16 | ID13 |

| ID REGISTER |
|---|
| ID1 |
| ID2 |
| ID3 |
| ID4 |
| ID5 |
| ID6 |
| ID7 |
| ID8 |
| ID9 |
| ID10 |
| ID11 |
| ID12 |
| ID13 |
| ID14 |
| ID15 |
| ID16 |

DISPLAY AND DISPLAY DRIVE CIRCUIT OR DISPLAY DRIVE METHOD

FIELD OF THE INVENTION

This invention relates to a display apparatus, a display driving circuit and a method for driving a display, having a plurality of lighting elements disposed in desired arrangement such as matrix shape or the like, and more particularly to a driving circuit or the like receiving lighting data such as image data or illuminating data or the like transferred from an external device such as a video processor or the like, transferring the data in a predetermined data format to a plurality of connected driving circuits, and performing various corrections of gradation, luminance, characteristics or the like.

BACKGROUND ART

This application claims priority based on patent applications No. 2000-230095 and No. 2000-230624 filed in Japan, the contents of which are incorporated herein by reference.

Recently, high-luminance light emitting elements, such as light emitting diodes (hereinafter, occasionally abbreviated to LEDs), have been developed for each of RGB that stands for red, green, and blue known as primary colors of light, and the production of large-scale self-luminance full color displays is being started. Further, various illumination such as an intelligent illumination which illuminates articles etc. with momentary changes in various color or brightness is being developed. Among others, LED displays have characteristics that they can be lightweight and slimmed-down, and that they consume less power, etc. Hence, a demand for LED displays as large-scale displays that can be used outdoors has been sharply increasing. Also, the use of LED displays has been diversified, and there has been a need for a system flexibly adaptable to various applications, such as large-scale TV sets, advertisements, billboards, traffic information, stereoscopic displays, and illuminations.

Generally, a dynamic driving system is employed in an LED display driving system. For example, in the case of an LED display constituted by M rows×N columns dot matrix, anode terminals of LEDs 11*a* disposed in each row, which are lighting elements, are commonly connected with one common source line 12, and cathode terminals of LEDs disposed in each column are commonly connected with a current line 13 of each column. Each of the current lines 13 can be connected with a constant-current source 14*a*, respectively. The common source lines 12 of M rows are turned ON in a predetermined period one after another, the LED driving current being impressed to the current lines 13 of N columns based on image data corresponding to the line turned ON. Accordingly, the LED driving current is impressed to the LEDs 11*a* of each pixel corresponding to the image data, and therefore, an image is indicated.

In the case of a large-scale LED display disposed in the outdoors, generally the LED display is assembled by a plurality of LED units to constitute spontaneous shape or size with relative ease, each of the LED units indicating each part of whole image data. LED units have light emitting diodes, which are one set of RGB, disposed on a substrate in a matrix shape, wherein each of the LED unit works as the LED display mentioned above similarly. In large-scale LED display units, many LEDs are employed, for example, in the case of 300 in longitude×400 in width, LEDs corresponding to 120,000 pixels are employed.

FIG. 1 is an exemplary explanatory diagram showing a flow of a signal in the driving circuits of each of the LED units mentioned above. An image indicating apparatus shown in FIG. 1 has a display section 1 having a plurality of lighting elements in a matrix shape, a vertical driving section 2 impressing voltage to each line of the display section 1 selectively and changing the line one after another in a vertical direction, and horizontal driving sections 3 corresponding to a plurality of columns providing each column in the selected line of the display section 1 with a driving current based on indicating data.

In the case of luminance gradation control by a pulse modulation system, gradation data (DATA) is input to the horizontal driving section 3 of the display apparatus. The vertical driving section 2 changes each line of the display section 1 one after another. With synchronizing image indicating a start of every line corresponding to each row of the display section 1, a lighting control signal input to a lighting control section 15 becomes in active. With synchronizing the lighting control signal, a latch signal (LATCH) to retain data of the image is input. The gradation data of each color is captured into shift resisters disposed in a memory section 17 of the LED driving section (LED Drivers 1–N) constituting the horizontal driving section 3, then shift clock (SCLK) synchronizing with the data is input to control sections 18 during an active period of the data. For example, the LED driving sections are constituted by the horizontal driving sections 3 having a predetermined number of constant-current outputs as driver ICs, which are modularized into ICs.

Each constant current driving section 14 disposed in the horizontal driving section 3 provides the driving current of each line provided to the display section 1. With synchronizing vertical driving section 2 control address (common control address) with the lighting control signal, a control signal synchronized is input from decoder 16, and accordingly, the constant current driving section 14 of the horizontal driving sections 3 connected with each column provides the driving current. The vertical driving section 2 changes each row of the display section 1 one after another to indicate.

In this driving circuit, with increasing pixel number of the lighting elements to be gradation-controlled simultaneously, many LED driving circuits driving the lighting elements are required. Further, each data of a signal group for driving control such as lighting control signal, gradation reference clock, gradation data, latch signal, shift clock or the like is required to be provided for each driver IC constituting each of the LED driving circuits.

However, the driving circuit mentioned above has a disadvantage due to an increase in the number of the lines of input signal interfaces for lighting control. Especially, nowadays a number of gradation is multiplied, and according to a gradation-multiplication of data, a width of gradation data bus is increased such as to 8 bit, 10 bit, and 12 bit. Furthermore, the driving circuit mentioned above needs a data signal group corresponding to 3 colors, which are RGB. A line pattern should be disposed among the driver ICs according to many lines, and therefore, the number of pattern lines is increased significantly, so that a driving substrate 42 becomes a complicated hand-wired multi-layered device having a high-cost. When signal terminals of the driver ICs are increased, their content become high and they occupy a majority of mounting content, and further, the number of terminals of connectors for the connecting interface is increased, and the size of the connectors become bigger, so that it has a disadvantage that the size of the substrate is further increased.

Further, various clock signals such as shift clock, gradation reference clock or the like are required to be provided for all of the driver ICs. Therefore, pattern hard-wire turning around in the same indicating apparatus causes a problem to occur of pulse deformation by reflection of the signal or variation of pulse width. Especially, with gradation-multiplication increasing, a frequency of the gradation clock should be higher, so that its influence becomes higher in circuit performance, and an influence to the data bus by radiation noise cannot be ignored. Therefore, although a PLL circuit can be employed in the driver IC to provide low frequency clock or the like, for example, this method makes the driver IC's cost higher, and has a problem not to be able to perform gamma-correcting by modulation of the gradation reference clock.

Furthermore, according to the driving circuit mentioned above or a data transferring system performing light control, there is a problem that an amount of transferring, and sequence of information, are different corresponding to a vertical driving duty ratio. When a connecting constitution of a plurality of driving circuit groups and lighting elements is changed, a transferring sequence of information transferred from an external control section should be changed also. Therefore, the control circuit is required to be redesigned and assembled. Further, an arrangement of the driving section or pattern hard-wire or the like designed to prevent signal deformation in the lighting device effectively cannot be optimized by changing the constitution, and there is a problem that matching between the external driving section is lost.

In addition, in a method disposing each driver IC, which is the horizontal driving section, in a transferring order of the data, the data is required to be transferred to each driver IC as individual information corresponding to the connecting order of the driver ICs one after another. However, this method requires determining the arrangement of the driver ICs before assembling the driving circuit.

On the other hand, elongating the signal line also has a problem. In related art, a signal flow in each row of a display—display section is constantly in one direction. For example, in a circuit constitution connecting each driver IC in a Z-shape as shown in FIG. 21, the signals are transferred from a left end to a right end, and then turns back to the left end in the next row. Therefore, the driver IC positioned at the right end is required to be connected with the driver IC positioned at the left end, so that there is a problem that elongating the signal line complicates hard-wire. Further, there is a problem that elongating the signal line causes reflecting deformation of the signal among the terminals, and that turning around and deformation of the signal generates noise and so on.

Besides, in Japanese laid-open patent publication No. H11-126047, the content of which is incorporated herein by reference, there is disclosed an LED indicating apparatus transferring data formatted in an ATM packet format to each LED unit, wherein the LED unit has a means for storing identification information added to each LED unit, and a comparing means for comparing the data from a control means with the identification information of each LED unit to perform a receiving process by selecting the data for its own therein, as an LED indicating apparatus and a method thereof. Similarly, there is disclosed an LED indicating apparatus assigning identification information to each LED unit automatically in Japanese laid-open patent publication No. 2000-221934, the content of which is incorporated herein by reference. In addition, the content of Japanese patent applications No. 2000-199420 and No. 2000-121649 filed in Japan, which are the prior filed applications, are incorporated herein by reference.

To solve the problem mentioned above, this invention further improves upon the prior applications. It is an object of the invention to provide a driving circuit etc., in which a simplifying circuit constitution with a smaller number of control signal lines or data lines provided to a driver IC makes the driver IC and a driving circuit board low-cost, while performing image indicating in high quality.

Another object of the present invention is to provide a display apparatus, which can adapt corresponding to a variation of disposition of driving sections in a display device or connecting formation form flexibly, with defining configuration of various data transferred to horizontal driving sections from a driving control section without influence according to a deference of a driving system of the indicating devices by disposing a communicating section communicating data in a common configuration to the horizontal driving sections in the display apparatus. Still another object of the present invention is to provide a driving circuit for a display apparatus etc., which is not required to transfer data in a signal line connecting order one after another by determining a destination of the data to be transferred, and therefore, horizontal driving sections can be connected relatively in a flexible manner.

SUMMARY OF THE INVENTION

A display apparatus of the invention comprises a display section 1 disposing a plurality of lighting elements 11, a vertical driving section 2, which can connect with each of the lighting elements 11 disposed in a row of the display section 1 selectively and can impress current to each of the lighting elements 11 connected in a selected row with switching every row in a vertical direction, a plurality of horizontal driving sections 3, which are connected in a column direction of the display section 1, providing lighting elements 11 connected in the selected row of the display section 1 by the vertical driving section 2 with current based on input data for the lighting elements 11 of each column, a driving control section 4, which receives various control data from an external device and performs lighting control of the display section 1 with synchronizing the vertical driving section 2 and the horizontal driving section 3 based on the control data, and a first communicating section 5 communicating the various control data with the external device. The display apparatus further comprises the driving control section 4 having a second communicating section 6 communicating data with each of the horizontal driving sections 3, wherein each of the horizontal driving sections 3 has a horizontal driving communicating section 8 communicating data with the second communicating section 6 and among the horizontal driving sections 3.

The display apparatus sets individual identification information 23 to discriminate the horizontal driving section 3 to each of the horizontal driving sections 3, and formats the data transferred to each of the horizontal driving sections 3 into a predetermined format with adding the identification information 23, wherein, the second communicating section 6 of the driving control section 4 transfers the data to the horizontal driving communicating section 8 of each of the horizontal driving sections 3, and the horizontal driving communicating section 8 performs a lighting control of the lighting elements 11.

Further, a display apparatus of the invention comprises a display section 1 disposing a plurality of lighting elements 11, a vertical driving section 2 driving each row of the display section 1 selectively, a plurality of horizontal driving sections 3 having horizontal driving communicating sections 8 communicating various control data, and driving to control lighting gradation based on the various control data with selecting the lighting elements of desired columns in a row selected by the vertical driving section 2, a driving control section 4 having a first communicating section 5 to communicate the various data with an external device and a second communicating section 6 connected with a plurality of the horizontal driving sections 3 serially, and controlling the vertical driving section 2 and the horizontal driving sections 3, wherein, the second communicating section 6 transfers data packets having a control field 21 including identification information 23, which is an ID to denote the horizontal driving sections 3 for the various control data to be transferred, control identification information 24 to denote a type of the control data, and an information field 22 including the control data to the horizontal driving sections 8, wherein the horizontal driving communicating sections 8 receive the control data for the horizontal driving sections 3, when the ID of identification information 23 of the transferred data packet 20 agrees with the ID stored in itself.

Furthermore, in the display apparatus, the horizontal driving section 3 stores a common ID to be received commonly for all of the horizontal sections 3 and the individual ID added individually to each of the horizontal sections 3 as identification information 23 to judge whether to perform a receiving process for the transferred data packet 20.

Furthermore, in the display apparatus, the horizontal driving communicating section 8 has a receiving section 28 performing a receiving process and an output selecting circuit 30 outputting the various control data input into the horizontal driving communicating section 8 and data input from the receiving section 28 selectively.

In the display apparatus, the horizontal driving communicating section 8 outputs the control field 21 of the input data packet 20 transparently from the output selecting circuit 30 and outputs the information field 22 with replacing for a predetermined data packet 20.

Furthermore, in the display apparatus, the predetermined data packet 20 is a disturbance data reading packet 20B having the identification information 23, the control field 21 including control identification information 24 denoting to read a disturbance data, and the information field 22 including dummy data 22B. The horizontal driving communicating section 8 further has a disturbance data retaining section 29 retaining the disturbance data its own. In the display apparatus, the horizontal driving communicating section 8 outputs the disturbance data retained in the disturbance data retaining section 29 with replacing dummy data included in the control field 22 of the disturbance data reading packet 20B received in the receiving section 28 of the horizontal driving section 3 with switching the output selecting circuit 30, when the identification information 23 of the data packet 20 received in the receiving section 28 of the horizontal driving section 3 agrees with its own individual ID and has the control identification information 23 denoting control type to read a disturbance data. Further, the driving control section 4 reads the disturbance data of the disturbance reading packet 20B transferred from the horizontal driving section 3.

In the display apparatus, the predetermined data packet 20 is a communication check packet 20C having the identification information 23, the control field 21 including control identification information 24 denoting a communication check, and the information field 22 including communication check data. The horizontal driving communicating section 8 further has a data reversing section 38 reversing data of the information field 22. In the display apparatus, the horizontal driving communicating section 8 outputs data from the data reversing section 38 with replacing the communication check data included in the information field 22 of the communication check packet 20C received in the receiving section 28 of the horizontal driving section 3 with switching the output selecting circuit 30, when the identification information 23 of the data packet 20 received in the receiving section 28 of the horizontal driving section 3 agrees with its own individual ID and has the control identification information 23 denoting control type of communication check. Further, the driving control section 4 performs a disturbance check of communication statement based on the data included in the information field 22 of each communication check packet 20C replied from each horizontal driving section 3 and the communication check data of the communication check packet 20C transferred to each horizontal driving section 3.

Furthermore, in the display apparatus, the horizontal driving communicating section 8 of the horizontal driving section 3 can output only in one direction, the output data from the horizontal driving communicating section 8 connected at end position of the lowest stream in data transferring direction in a plurality of the horizontal driving position 3 connected serially is input to the second communicating section 6 of the driving control section 4. Thus the data is transferred to each of the horizontal driving sections in a loop shape.

Furthermore, in the display apparatus, the driving control section 4 or the horizontal driving section 3 has a first reference clock generating section 7 generating first reference clock to control lighting gradation. The horizontal driving section 3 further has a lighting control section 15 controlling lighting gradation based on the reference clock, a second reference clock generating section 19 generating second reference clock synchronizing the various control data input from the driving control section 4, a reference clock selecting circuit 36, to which is input the first reference clock and the second reference clock is input, and selects the first reference clock or the second reference clock alternatively to output as the reference clock to control lighting gradation.

Furthermore, in the display apparatus, the horizontal driving section 3 further has a first counter 33 counting an input of the first reference clock and generating a clear signal every predetermined count number, a second counter 34 counting input of the second reference clock until being input the clear signal from the first counter 33. The reference clock selecting circuit 36 selects the reference clock from the first reference clock to the second reference clock, when count number of the second counter 34 clock becomes higher than a predetermined value.

Furthermore, in the display apparatus, the horizontal driving section 3 has a third counter 40 counting an input of the first reference clock and retaining predetermined data when count number of the input first reference data becomes a predetermined value, and clearing the count number of the first reference clock when the horizontal driving communicating section 8 receives a frame start packet denoting frame synchronizing. The disturbance data retaining section 29 retains data denoting an occurrence of disturbance of the first reference clock, when count number of the third counter is less than the predetermined value. The driving control section 4 reads the data denoting an occurrence of disturbance of the first reference clock by the disturbance data reading packet 20B, controls the reference clock selecting circuit 36 of the horizontal driving section 3 causing the disturbance to select from the first reference clock to the second reference clock by the data packet 20.

Furthermore, in the display apparatus, the predetermined value of the count number of the first reference clock is set based on an indicating gradation number of one frame.

Furthermore, the display apparatus comprises a substrate integrated with a lighting element board 41 disposing the lighting elements 11 and a driving circuit board 42 having driving circuits 10 driving the lighting elements 11. The driving circuits 10 are disposed between each of the lighting elements.

Further, a display apparatus of the invention comprises a display section 1 disposing a plurality of lighting elements 11, a vertical driving section 2 driving each row of the display section 1 selectively, a plurality of horizontal driving sections 3 having horizontal driving communicating sections 8 communicating various control data, driving to control lighting gradation based on the various control data with selecting the lighting elements 11 of desired columns in a row selected by the vertical driving section 2, a driving control section 4 having a first communicating section 5 to communicate the various data with an external device and a second communicating section 6 connected with a plurality of the horizontal driving sections 3 serially, and controlling the vertical driving section 2 and the horizontal driving sections 3. In the display apparatus, the horizontal driving sections 3 are connected to each other by signal lines and can communicate the data with the driving control section 4, the driving control section 4 adds identification information 23 to transferred control data to each horizontal driving section 3 corresponding to a connecting formation of the horizontal driving sections 3 in the display section 1 and transfers various control data, and the horizontal driving sections 3 perform a lighting control of the lighting elements 11.

Furthermore, in the display apparatus, the driving control section 4 further has an identification information storing section 25 storing IDs added to the horizontal driving sections 3 according to order to transfer the control data to the horizontal driving section 3 corresponding to path of the signal lines connecting the horizontal driving sections 3 to each other. The driving control section 4 transfers the control data input from an external device with adding the IDs read from the identification information storing section 25 corresponding to each horizontal driving section 3 one after another to the horizontal driving sections 3 in data packet format.

Further, a display apparatus of the invention comprises a display section 1 disposing a plurality of lighting elements 11, a vertical driving section 2 driving each row of the display section 1 selectively, a plurality of horizontal driving sections 3 having horizontal driving communicating sections 8 communicating various control data, driving to control lighting gradation based on the various control data with selecting the lighting elements of desired columns in a row selected by the vertical driving section 2, a driving control section 4 having a first communicating section 5 to communicate the various data with an external device and a second communicating section 6 connected with a plurality of the horizontal driving sections 3 serially, and controlling the vertical driving section 2 and the horizontal driving sections 3. In the display apparatus, the horizontal driving communicating sections 8 of the horizontal driving sections 3 has a horizontal driving side identification information storing section 29 storing identifying ID 23*a* denoting IDs of each of the horizontal driving sections 3, the identifying ID 23*a* of each the horizontal driving section 3 stored in the horizontal driving side identification information storing section 29 is set to deferent identifying IDs 23*a* from the horizontal driving section 3 connected with the second communicating section 6 side one after another based on a predetermined calculation.

Furthermore, in the display apparatus, the horizontal driving communicating section 8 of the horizontal driving section 3 has a receiving section 28 inputting and outputting data, an output selecting circuit 30 outputting data input to the horizontal driving section 3 or the data output from the receiving section 28 selectively, when setting a command to set the ID of the horizontal driving section 3 is input, the horizontal driving communicating sections 8 controls to switch the data output of the output selecting circuit 30 from the data input to the horizontal driving section 3 to the data output through the receiving section 28, and to store the identifying ID 23*a* input to the receiving section 28 to the horizontal driving side identification information storing section 29 and to output a identifying ID 23*a*, which is performed the predetermined calculation against the identifying ID 23*a* input to the receiving section 28 from the output selecting circuit 30.

Furthermore, in the display apparatus, the horizontal driving communicating sections 8 of the horizontal driving section 3 has a receiving section 28 inputting and outputting data, a output selecting circuit 30 outputting data input to the horizontal driving section 3 or the data output from the receiving section 28 selectively, when setting a command to set the ID of the horizontal driving section 3 is input, the horizontal driving communicating sections 8 controls to switch the data output of the output selecting circuit 30 from the data input to the horizontal driving section 3 to the data output through the receiving section 28, and to store a identifying ID 23*a*, which is performed by the predetermined calculation against the identifying ID 23*a* input to the receiving section 28, to the horizontal driving side identification information storing section 29 and to the identifying ID performed the predetermined calculation from the output selecting circuit 30.

Furthermore, in the display apparatus, the horizontal driving communicating sections 8 of the horizontal driving section 3 controls to switch the data output of the output selecting circuit 30 from the data through the receiving section 28 to the data input to the horizontal driving section 3 after outputting the identifying ID performed the predetermined calculation from the output selecting circuit 30.

Furthermore, in the display apparatus, the display section is constituted by a plurality of indicating blocks 10 divided into m rows×n columns m, n being an integer and two or more areas, wherein the horizontal driving sections 3 are connected from the second communicating section 6 side one after another toward the horizontal direction serially, and the horizontal driving section 3 connected at an end column of the lowest stream in each row is connected with the horizontal driving section 3 of the same column in a next row.

Furthermore, in the display apparatus, the horizontal driving section 3 judges whether to perform a receiving process against the transferred data packets based on the identification information 23 added to the data packets or not, by storing an individual ID, which is added to each horizontal driving section 3 individually, to the identification information storing section 25, wherein, the horizontal driving section 3 stores a common ID to be received by all of the horizontal driving sections 3 commonly.

Furthermore, in the display apparatus, a plurality of the lighting elements 11 are disposed in a matrix shape in the display section 1.

Furthermore, in the display apparatus, the control data is image data for image-displaying.

Furthermore, in the display apparatus, the control data is illuminating data for an illumination.

Furthermore, a display driving circuit driving a display apparatus, which has a display section 1 disposing a plurality of lighting elements 11, comprises a vertical driving section 2 driving each row of the display section 1 selectively, a plurality of horizontal driving sections 3 having horizontal driving communicating sections 8 communicating lighting data for lightening the lighting elements, performing light-driving based on the lighting data with selecting the lighting elements of desired columns in a row selected by the vertical driving section 2, and a driving control section 4 having a first communicating section 5 to communicate the lighting data with external and a second communicating section 6 connected with a plurality of the horizontal driving sections 3 serially, and controlling the vertical driving section 2 and the horizontal driving sections 3.

The horizontal driving sections 3 are added IDs to discriminate itself, the second communicating section 6 transfers data packets having control field 21 including identification information 23, which is the ID to discriminate the horizontal driving sections 3 to be transferred the lighting data, and control identification information 24 to denote type of the lighting data, and an information field 22 including the lighting data to the horizontal driving sections 3, wherein the horizontal driving communicating section 8 receives the lighting data for the horizontal driving sections 3, when the ID of identification information of the transferred data packet 20 agrees with ID added to itself.

Furthermore, a display driving circuit driving a display apparatus, which has a display section 1 disposing a plurality of lighting elements 11 and a vertical driving section 2 driving each row of the display section 1 selectively, comprises a plurality of horizontal driving sections 3 having horizontal driving communicating sections 8 communicating lighting data for lightening the lighting elements, performing light-driving based on the lighting data with selecting the lighting elements of desired columns in a row selected by the vertical driving section 2, and a driving control section 4 having a first communicating section 5 to communicate the lighting data with an external device and a second communicating section 6 connected with a plurality of the horizontal driving sections 3 serially, and controlling the vertical driving section 2 and the horizontal driving sections 3.

The horizontal driving sections 3 have added IDs to discriminate itself, the second communicating section 6 transfers data packets having a control field 21 including identification information 23, which is the ID to discriminate the horizontal driving sections 3 to be transferred the lighting data, and control identification information 24 to denote type of the lighting data, and an information field 22 including the lighting data to the horizontal driving sections 3, the horizontal driving communicating section 8 receives the lighting data for the horizontal driving sections 3, when the ID of identification information 23 of the transferred data packet 20 agrees with ID added to itself.

Furthermore, a display driving circuit driving a display apparatus has a display section 1 disposing a plurality of lighting elements 11, a vertical driving section 2 driving each row of the display section 1 selectively, and a plurality of horizontal driving sections 3 having horizontal driving communicating sections 8 communicating lighting data for lightening the lighting elements, performing light-driving based on the lighting data with selecting the lighting elements of desired columns in a row selected by the vertical driving section 2, comprises, a driving control section 4 having a first communicating section 5 to communicate the lighting data with an external device and a second communicating section 6 connected with a plurality of the horizontal driving sections 3 serially, and controlling the vertical driving section 2 and the horizontal driving sections 3.

The horizontal driving sections 3 have added IDs to discriminate itself, the second communicating section 6 transfers data packets having control field 21 including identification information 23, which is the ID to discriminate the horizontal driving sections 3 to be transferred the lighting data, and control identification information 24 to denote a type of the lighting data, and an information field 22 including the lighting data to the horizontal driving sections 3, the horizontal driving communicating section 8 receives the lighting data for the horizontal driving sections 3, when the ID of identification information of the transferred data packet 20 agrees with ID added to itself.

Furthermore, a display driving circuit driving a display apparatus has a display section 1 disposing a plurality of lighting elements 11. The display driving circuit comprises, a vertical driving section 2 driving each row of the display section 1 selectively, a plurality of horizontal driving sections 3 having horizontal driving communicating sections 8 communicating lighting data for lightening the lighting elements, performing light-driving based on the lighting data with selecting the lighting elements of desired columns in a row selected by the vertical driving section 2, and a driving control section 4 having a first communicating section 5 to communicate the lighting data with external and a second communicating section 6 connected with a plurality of the horizontal driving sections 3 serially, and controlling the vertical driving section 2 and the horizontal driving sections 3.

The horizontal driving sections 3 are connected to each other by signal lines and can communicate the data with the driving control section 4, wherein the driving control section 4 adds identification information 23 to transferred lighting data to each horizontal driving section 3 corresponding to a connecting formation of the horizontal driving sections 3 in the display section 1 and transfers the lighting data, and the horizontal driving sections 3 perform lighting control of the lighting elements 11. The driving control section 4 further has an identification information storing section 25 storing IDs added to the horizontal driving section 3 according to order to transfer the lighting data to the horizontal driving section 3 corresponding to a path of the signal line connecting the horizontal driving sections 3 to each other. The driving control section 4 transfers the lighting data transferred from an external device with adding the IDs read from the identification information storing section 25 corresponding to each horizontal driving section 3 one after another to the horizontal driving sections 3 in data packet format.

Furthermore, a display driving circuit driving a display apparatus has a display section 1 disposing a plurality of lighting elements 11 and a vertical driving section 2 driving each row of the display section 1 selectively. The display driving circuit comprises a plurality of horizontal driving sections 3 having horizontal driving communicating sections 8 communicating lighting data for lightening the lighting elements, performing light-driving based on the lighting data with selecting the lighting elements of desired columns in a row selected by the vertical driving section 2, and a driving control section 4 having a first communicating section 5 to communicate the lighting data with an external device and a second communicating section 6 connected with a plurality of the horizontal driving sections 3 serially, and controlling the vertical driving section 2 and the horizontal driving sections 3.

The horizontal driving sections 3 are connected to each other by signal lines and can communicate the data with the driving control section 4, wherein the driving control section 4 adds identification information 23 to transferred lighting data to each horizontal driving section 3 corresponding to a connecting formation of the horizontal driving sections 3 in the display section 1 and transfers the lighting data, and the horizontal driving sections 3 perform lighting control of the lighting elements 11. The driving control section 4 further has an identification information storing section 25 storing IDs added to the horizontal driving section 3 according to order to transfer the lighting data to the horizontal driving section 3 corresponding to path of the signal line connecting the horizontal driving sections 3 to each other, the driving control section 4 transfers the lighting data input from external with adding the IDs read from the identification information storing section 25 corresponding to each horizontal driving section 3 one after another to the horizontal driving sections 3 in data packet format.

Furthermore, a display driving circuit driving a display apparatus has a display section 1 disposing a plurality of lighting elements 11, a vertical driving section 2 driving each row of the display section 1 selectively, and a plurality of horizontal driving sections 3 having horizontal driving communicating sections 8 communicating lighting data for lightening the lighting elements, performing light-driving based on the lighting data with selecting the lighting elements of desired columns in a row selected by the vertical driving section 2. The display driving circuit comprises a driving control section 4 having a first communicating section 5 to communicate the lighting data with an external device and a second communicating section 6 connected with a plurality of the horizontal driving sections 3 serially, and controlling the vertical driving section 2 and the horizontal driving sections 3.

The horizontal driving sections 3 are connected to each other by signal lines and can communicate the data with the driving control section 4. The driving control section 4 adds identification information 23 to transferred lighting data to each horizontal driving section 3 corresponding to a connecting formation of the horizontal driving sections 3 in the display section 1 and transfers the lighting data, and the horizontal driving sections 3 perform lighting control of the lighting elements 11. The driving control section 4 further has an identification information storing section 25 storing IDs added to the horizontal driving section 3 according to order to transfer the lighting data to the horizontal driving section 3 corresponding to a path of the signal line connecting the horizontal driving sections 3 to each other. The driving control section 4 transfers the lighting data input from an external device with adding the IDs read from the identification information storing section 25 corresponding to each horizontal driving section 3 one after another to the horizontal driving sections 3 in data packet format.

Furthermore, a method for driving a display apparatus of the invention, which has a display section 1 disposing a plurality of lighting elements 11, a vertical driving section 2 driving each row of the display section 1 selectively, and a plurality of horizontal driving sections 3, which have horizontal driving communicating sections 8 communicating lighting data for lightening the lighting elements and perform light-driving based on the lighting data with selecting the lighting elements of desired columns in a row selected by the vertical driving section 2, are connected each other by a signal line and can communicate the data with a driving control section 4.

The method for driving a display apparatus comprises a step that the driving control section 4 stores IDs added to the horizontal driving section 3 corresponding to a path of the signal line connecting the horizontal driving sections 3 to each other, a step that the driving control section 4 adds IDs identifying the horizontal driving sections 3 to the horizontal driving sections 3, a step that the driving control section 4 transfers the lighting data input from an external device with adding the stored IDs corresponding to each horizontal driving section 3 one after another to the horizontal driving sections 3 in data packet format, and a step that the horizontal driving sections 3 receive the data packet for itself and perform a predetermined process, and then transfer the data to the horizontal driving section 3 connected next or the driving control section 4.

Furthermore, a driving circuit of a display apparatus of the invention comprises:

(a) the driving circuit of the image display apparatus has a display section 1 disposing a plurality of lighting elements 11 in a matrix shape, a vertical driving section 2 driving each row of the display section 1 selectively, a plurality of horizontal driving sections 3 having horizontal driving communicating sections 8 communicating various control data including image data, driving to control lighting gradation based on the various control data with selecting the lighting elements of desired columns in a row selected by the vertical driving section 2, a driving control section 4 having a first communicating section 5 to communicate the various data with external and a second communicating section 6 connected with a plurality of the horizontal driving sections 3 serially, and controlling the vertical driving section 2 and the horizontal driving sections 3, (b) the second communicating section 6 transfers data packets having a control field 21 including identification information 23, which is the ID to denote the horizontal driving sections 3 to be transferred the various control data, and control identification information 24 to denote a type of the control data, and an information field 22 including the control data to the horizontal driving sections 3, the horizontal driving communicating section 8 receives the control data for the horizontal driving sections 3, when the ID of identification information of the transferred data packet 20 agrees with ID stored in its own.

Furthermore, a driving circuit of a display apparatus of another invention comprises:

(a) the driving circuit of the image display apparatus has a display section 1 disposing a plurality of lighting elements 11 in a matrix shape, a vertical driving section 2 driving each row of the display section 1 selectively, a plurality of horizontal driving sections 3 having horizontal driving communicating sections 8 communicating various control data including image data, driving to control lighting gradation based on the various control data with selecting the lighting elements of desired columns in a row selected by the vertical driving section 2, and a driving control section 4 having a first communicating section 5 to communicate the various data with external and a second communicating section 6 connected with a plurality of the horizontal driving sections 3 serially, and controlling the vertical driving section 2 and the horizontal driving sections 3, (b) the horizontal driving sections 3 are connected to each other by signal lines and can communicate the data with the driving control section 4, the driving control section 4 adds identification information 23 to transferred control data to each horizontal driving section 3 corresponding to connecting formation of the horizontal driving sections 3 in the display section 1 and transfers the various control data, and the horizontal driving sections 3 perform lighting control of the lighting elements 11, (c) the driving control section 4 further has an identification information storing section 25 storing IDs added to the horizontal driving section 3 according to order to transfer the control data to the horizontal driving section 3 corresponding to a path of the signal line connecting the horizontal driving sections 3 to each other, (d) the driving control section 4 transfers the control data input from an external device with adding the IDs read from the identification information storing section 25 corresponding to each horizontal driving section 3 one after another to the horizontal driving sections 3 in data packet format.

DETAILED DESCRIPTION OF THE INVENTION

Figure 1:
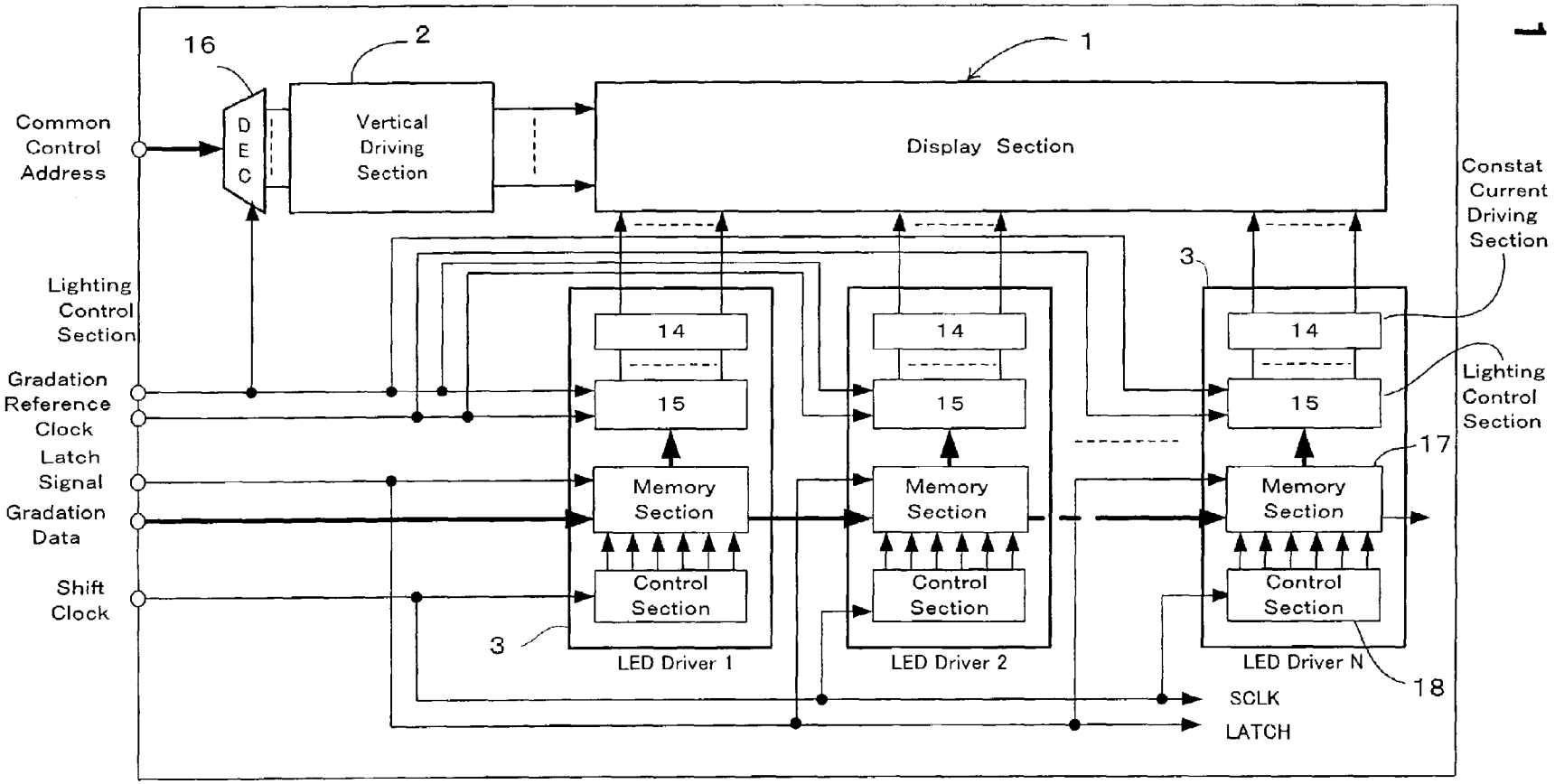
FIG. 1 is a block diagram showing a driving circuit of a display apparatus for comparison with this invention.

The following description will describe an embodiment of the invention with reference to the drawings. It should be appreciated, however, that the embodiment described below is an illustration of a display apparatus, a display driving circuit and a method for driving a display to give a concrete form to technical ideas of the invention, and a display apparatus, a display driving circuit and a method for driving a display according to the present invention are not especially limited to the description below.

Further, in this specification, although numbers corresponding to members represented in the embodiments are added to member represented in "claims" and "Summary of The Invention" to help to understand claims, the numbers never restrict the claims to the members in the embodiments.

In this specification, control data denotes data needed for image displaying or lighting of lighting elements such as lighting data including image data, luminance correcting data, constant current adjusting data, enable control, horizontal synchronization data and so on. In this specification, it is also merely called data as a matter of convenience. Further, the data for a display apparatus etc. is not only image data for full-color, but also a subtractive process image, limited color such as two or three or the like, monochrome gradation representing can be applied, for example. Furthermore, it can be applied to not only image displaying, but also characters and diagram data displaying. In addition, it can be applied to lighting. When it is used for lighting, changing light intensity or a dimmer function can be added. In this specification, the display apparatus can include a lighting apparatus employing lighting or other illuminant.

Furthermore, in this specification, although row direction, vertical direction and so on are used to represent a disposing direction as a matter of convenience, horizontal and vertical are called one direction to be set spontaneously and another direction, in the case disposing in a matrix shape. Besides, these do not define horizontal direction, vertical direction strictly, can include relatively inclined direction. Furthermore, the invention can include disposing in an oblique direction. In this case, row direction and vertical direction can be understood as "first oblique direction", which is one of two oblique directions crossing each other and "second oblique direction", which is another oblique direction respectively.

In addition, in this specification, a display apparatus can include an apparatus working as an image displaying or a lighting display by itself, an apparatus working as a unit type display, which can constitute a large-scale display by being assembled with a plurality of the units, or can be assembled in various shapes flexibly.

Furthermore, in this specification, the display apparatus, the display driving apparatus, and the driving circuit can include these apparatus or circuit assembled with a plurality of members, or assembled with a single device or a single member. For example, an apparatus can be constituted by a display section arranged outside with lighting elements, and the driving circuit assembled with devices or circuits, which perform a single or a plurality of functions, such as a chip working as a vertical driving section driving the display section, a chip working as a horizontal driving section, a chip working as a driving control section with a first communicating section and a second communicating section, for light-driving the display section. Further, the apparatus can be constituted to perform a vertical driving section, a horizontal driving section, driving control section and so on, by a single chip or a circuit substrate with lighting elements thereto.

A display apparatus of an embodiment of the invention has a display section 1 disposing lighting elements 11 in a desired shape such as a line shape or a dot matrix shape or the like. Here, the display section is constituted with disposing pixels in a matrix shape. Each of the pixels has the lighting elements corresponding to each of RGB colors. Each of the lighting elements 11 disposed in display section 1 is wired to be connected electrically with a vertical driving section 2 in a horizontal direction by switching, and to be connected with horizontal driving sections 3 corresponding to each column in a vertical direction.

Further, the lighting elements 11 or the pixels can be disposed not only in a matrix shape but also in a staggered shape, in zigzag or in oblique directions in the display section. For example, when the lighting elements 11 are disposed in a staggered shape with offset each centerline, wires connecting each of the lighting elements 11 can be wired with cross in vertical and horizontal directions. Furthermore, when the wires are wired in oblique directions, the wires can be wired in an X-shape to drive both directions corresponding to the vertical direction and the horizontal direction respectively. In addition, a wiring pattern for a power supply to the lighting elements 11 and lighting elements disposing position is not always necessary coincident, the lighting elements 11 can be disposed in an oblique direction in a wiring pattern with a grid shape by selecting positions with a predetermined pitch, which are cross of the wiring pattern with a grid shape. Besides, the lighting elements 11 can be disposed off the cross of the wiring pattern in a grid shape with extending the electric wire such as a lead or a pattern to electrodes of the lighting elements for connecting. In this way, a pattern disposing the pixels constituted by the lighting elements 11 can be set spontaneously.

The vertical driving section 2 impresses current to the lighting elements 11 connected with spontaneous one row or a plurality of rows of the display section 1. The vertical driving section 2 scans in a vertical direction with selecting each row of the display section 1 one after another and impresses current to all of the rows with swicthing rows. Besides, a way of selecting each row of the display section 1 employs not only selecting in a vertical direction from upside to down side one after another with swicthing, but also can employ spontaneous selecting ways, which are selecting every one row such as every odd row, even row, or scanning bi-direction from a down side to an up side and upside to down side or selecting by a plurality of rows or the like.

The horizontal driving sections 3 are connected with every row or by a plurality of the rows. A plurality of the horizontal sections 3 are disposed in a plurality of rows and/or columns. The lighting elements 11 connected with the row selected by the vertical driving section 2 are supplied driving current from the horizontal driving sections 3 connected to each column. The horizontal driving sections 3 supply the current according to image data, based on control data for display transferred from a driving control section 4, corresponding to the selected row. The driving control section 4 performs a gradation control of predetermined pixel number as one unit.

The driving control section 4 transfers various control data to the horizontal driving sections 3. Especially, the driving control section 4 can transfer not only the same data to all of the horizontal driving sections 3, but also particular data to a particular horizontal driving section 3. The driving control section 4 sets individual identification information 23 to each of the horizontal driving sections 3 to perform data receiving process individually. Further, the driving control section 4 transfers the identification information 23 to denote the horizontal driving section 3 with data to be needed such as control identification information 24, control data etc. in sequential data packet format. The horizontal driving section 3 discriminates whether the data is for itself or not based on the identification information 23 added to the data, and performs a receiving process to a data packet 20 to be received, and drives the display section 1 with current.

The horizontal driving sections 3 store individual IDs 23A set to each of horizontal driving sections individually as identification information 23 to discriminate whether to perform receiving process or not. In addition, the horizontal driving sections 3 can store a common ID 23B to be received by all of the horizontal driving sections 3 commonly.

Figure 7:
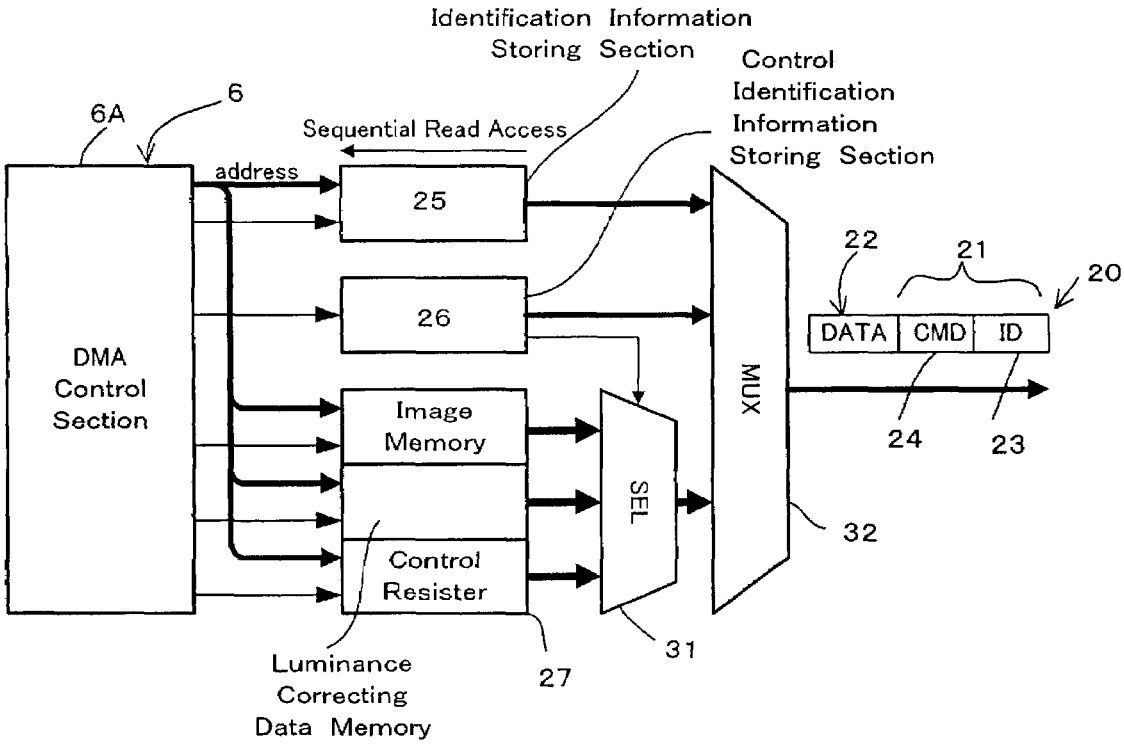
FIG. 7 is a block diagram showing a packet data transferring circuit of a driving control section.

As shown in FIG. 7, the driving control section 4 has an identification information storing section 25, a control identification information storing section 26, and a data storing section 27. For example, the data storing section 27 has an image memory storing the image data, a luminance correcting data memory storing luminance correcting data, a control resister and so on. The identification information storing section 25 retains the identification information 23 allocated to each horizontal driving section 3. Similarly, the control identification information storing section 26 retains control identification information 24 denoting a type of the transferred control data.

Various control data such as the image data transferred from an external image processor etc., luminance correcting data or the like are retained in the data storing section 27 temporarily. The data storing section 27 is constituted by a semiconductor memory etc. The data storing section 27 is required to have fast-access so that is constituted by a RAM (Random Access Memory) preferably. A DMA control section 6A, which is a second communicating section 6, reads this data from the data storing section 27 directly, and transfers to the horizontal driving sections 3.

The driving control section 4 reads from the identification information storing section 25 in a predetermined period sequentially (address sequential reading), and reads retained data such as the image data, the luminance correcting data or the like, from the data storing section 27 based on predetermined start address and data length. Then the identification information 23 (ID), the control identification information 24 (CMD), various data (DATA) are formatted into sequential data by a multiplex circuit (MUX) 32 such as a mutiplexer, and transferred from the driving section 4 to the horizontal driving sections 3. Thus, when each image data or the luminance correcting data or the like to control each horizontal driving section 3 are transferred from the driving control section 4 to the horizontal driving sections 3, data is inserted into an information field 22, the identification information 23 denoting the destination horizontal driving section 3 and the control identification information 24 denoting type of the data are inserted into a control field 21, so that they are transferred to the destination horizontal driving section 3.

The driving control section 4 further has a first communicating section 5, a second communicating section 6, and a first reference clock generating section 7. The first communicating section 5 communicates various data with a controller connected with an external apparatus and other display apparatus, and commands to the second communicating section 6. The second communicating section 6 performs a process such as correcting data received from the first communicating section 5, and outputs to the horizontal driving sections 3. Further, the first reference clock generating section 7 performs a process such as switching a current source by a horizontal line control of the vertical driving section 2 or generating a gradation reference clock.

Furthermore, the driving circuit of the invention provides each horizontal driving section 3 with the identification information 23, and it is set as destination of the data, which is constituted by various data such as a lighting control signal, image data, luminance correcting data, control data or the like with formatted into packet format. The horizontal driving section 3 has a horizontal side communicating section 8, so that the horizontal driving section 3 can communicate with the driving control section 4 and other horizontal driving sections in a predetermined communication protocol. Accordingly, transferring various data by a common line performs a driving control of the horizontal driving sections 3, and a number of various control signal lines can be reduced.

The horizontal driving section 3 side stores the individual ID 23A added to each horizontal driving section 3 individually as the identification information to discriminate whether to perform a receiving process or not. Further, the horizontal driving sections 3 additionally can store the common ID 23A set data to be received by all of the horizontal driving sections 3 commonly. For example, the horizontal driving side identification information storing section 29 is allocated into an individual identification information storing section 47A to store the individual identification information 23A and a common identification information storing section 47B to store the common ID 23B. Besides, the horizontal driving sections 3 do not always store the common ID 23B, all of the horizontal driving sections 3 can be set to receive the data when ID=0, for example.

Although signals to be needed for driving control in the display apparatus such as a timing signal etc. can be input from an external signal source or an external controller, a minimum of them to be needed also can be generated by a control section in the display apparatus without input from external directly. For example, a control signal to control the vertical driving section 2, a gradation reference clock to perform gradation control to the horizontal driving section 3, a receiving clock and so on can be generated autonomously.

Control between an external controller controlling the display apparatuses from external and the display apparatuses, which are a kind of the lighting apparatuses, is achieved by setting each of the connected display apparatuses as address space, and constituting hardware with defining address space of each display apparatus, so that the control can be merely achieved by command data. For example, storing address of the memory to store these data is allocated corresponding to a specification of the display apparatus (pixel number, matrix constitution, whether it needs correcting data or not, and so on). When the image data is required to be changed, the image data of the storing address of the display apparatus to be changed is rewritten.

When performing dynamic driving, row line switching number of the display section 1 by the vertical driving section 2, i.e. driving duty ratio of the driver circuit, is sometimes varied depending on the display apparatus. Therefore, a control circuit of the external controller side is generally constituted corresponding to a driving type of the display apparatus. However, in constitution of the driving circuit of the invention, when one frame of image data, i.e. image data corresponding to an amount of one vertical period, is transferred from the external controller, the display apparatus such as an image displaying apparatus can store one time of light-displaying data such as into an internal memory. Therefore, a hardware constitution of the display apparatus side operates corresponding to its own driving type, so that the external controller is not required to store a driving type of each display apparatus. Accordingly, different type displays can be assembled flexibly.

Further, in the invention, an order of transferring image display data etc. is not always the same as an order of disposing the horizontal driving section 3. Dividing an area of display section 1 into a plurality of blocks, so that data transferring order to each divided blocks can be changed corresponding to a connecting form among the horizontal driving section flexibly. Concretely, the area, which is performed displaying control by each of horizontal driving sections 3 in the display section 1, is divided into m rows×n columns (m and n are integer and equal or more than two) display blocks 100, and the data is transferred to the horizontal driving section 3 by the display block 100 as one unit.

Figure 17:
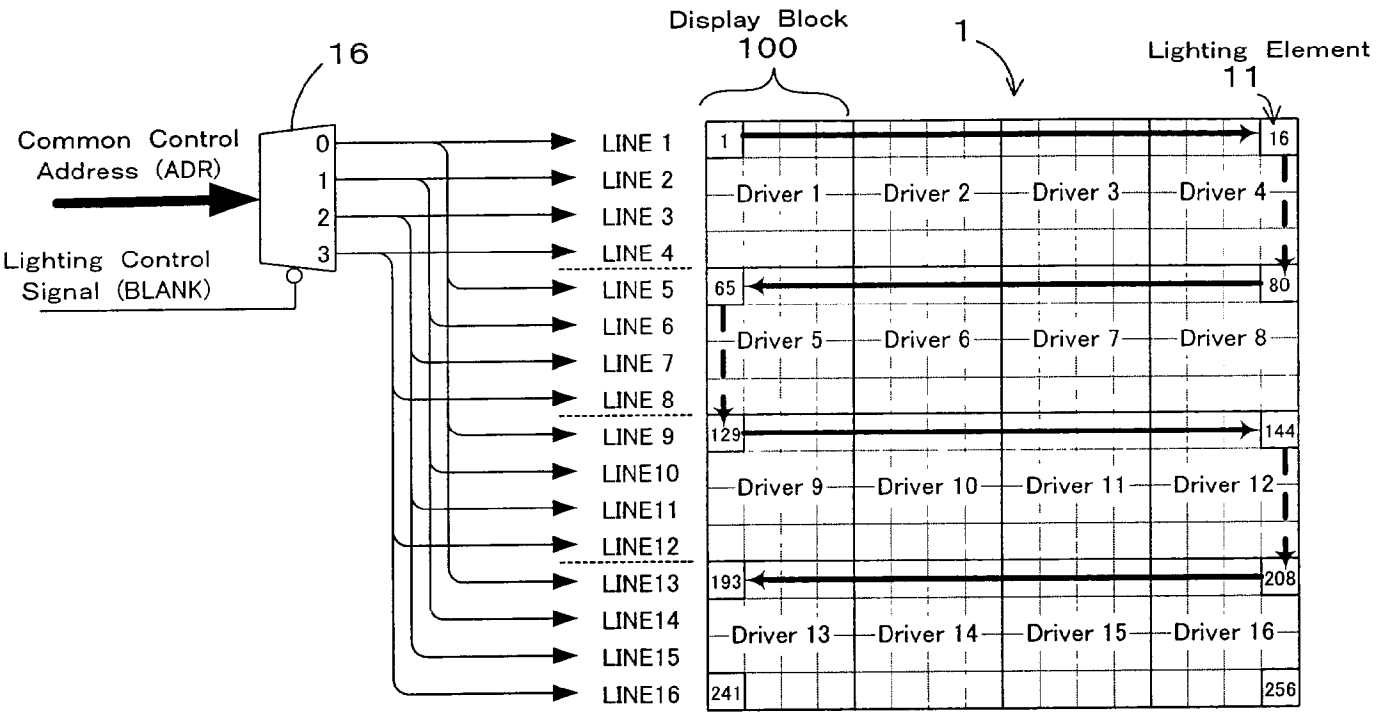
FIG. 17 is a schematic diagram showing a connecting status connecting a vertical driving section with display blocks of each row of a display section.

Various wire connecting form transferring the data to the display block 100 can be applied. For example, as shown in FIG. 17, each display block 100 can communicate the data with being connected in an S-shape. In this case, the display blocks 100 are serially connected in horizontal direction in the display section, the display block 100 positioned at end section is connected with the adjacent display block in vertical direction, to be connected in an S-shape serially. The data is transferred along the path of the signal line. Communicating the data packets can employ not only parallel transferring, but also serial transferring.

To transfer the data packets in this constitution of the display section 1, an order of transferring the control data such as generated image data etc. does not correspond with an order of connecting the display blocks 100 therein. To solve the problem, in the invention, the transferred data corresponding to each display block 100 is transferred with having added information of destination and formatted in packet format. Accordingly, adding the individual identifying ID 23*a* to the horizontal driving section 3 corresponding to each display block 100 precedently can control the desired horizontal driving section 3 individually. In the invention, adding the identifying ID 23*a* to the horizontal driving section 3 can be performed by the driving control section 4 automatically. The display constituted capable to set the identifying ID 23*a* initially has an advantage not always to be fixed to wire among the display block s100 according to data transferring order, and to be constituted flexibly, so that the display section can be designed easily.

The identification information 23*a* has the individual ID 23A to be received by each of the horizontal driving section 3 individually and the common ID 23B to be received by all of the horizontal driving section 3 commonly. Each of the horizontal driving sections 3 stores the individual ID in the horizontal driving identification information storing section 47. Adding identification information 23 denoting these identifying IDs 23*a* achieves the features described above.

The driving control section 4 adds the identification information 23 to the data to be transferred to each the horizontal driving section 3. Therefore, the horizontal driving sections 3 can perform a receiving process selectively with identifying whether the data packet is transferred to itself or not.

The data is not always required to transfer according to an order of disposing the display blocks 100 in data transferring. In other words, changing a connecting form of the horizontal driving sections 3 corresponding to each display block 100 does not require to correspond disposing order in the display section with data transferring order. Because the horizontal driving section side can discriminate the data for itself, when the driving control section side sets the individual IDs, the data packets can be transferred in spontaneous order.

Figure 21:
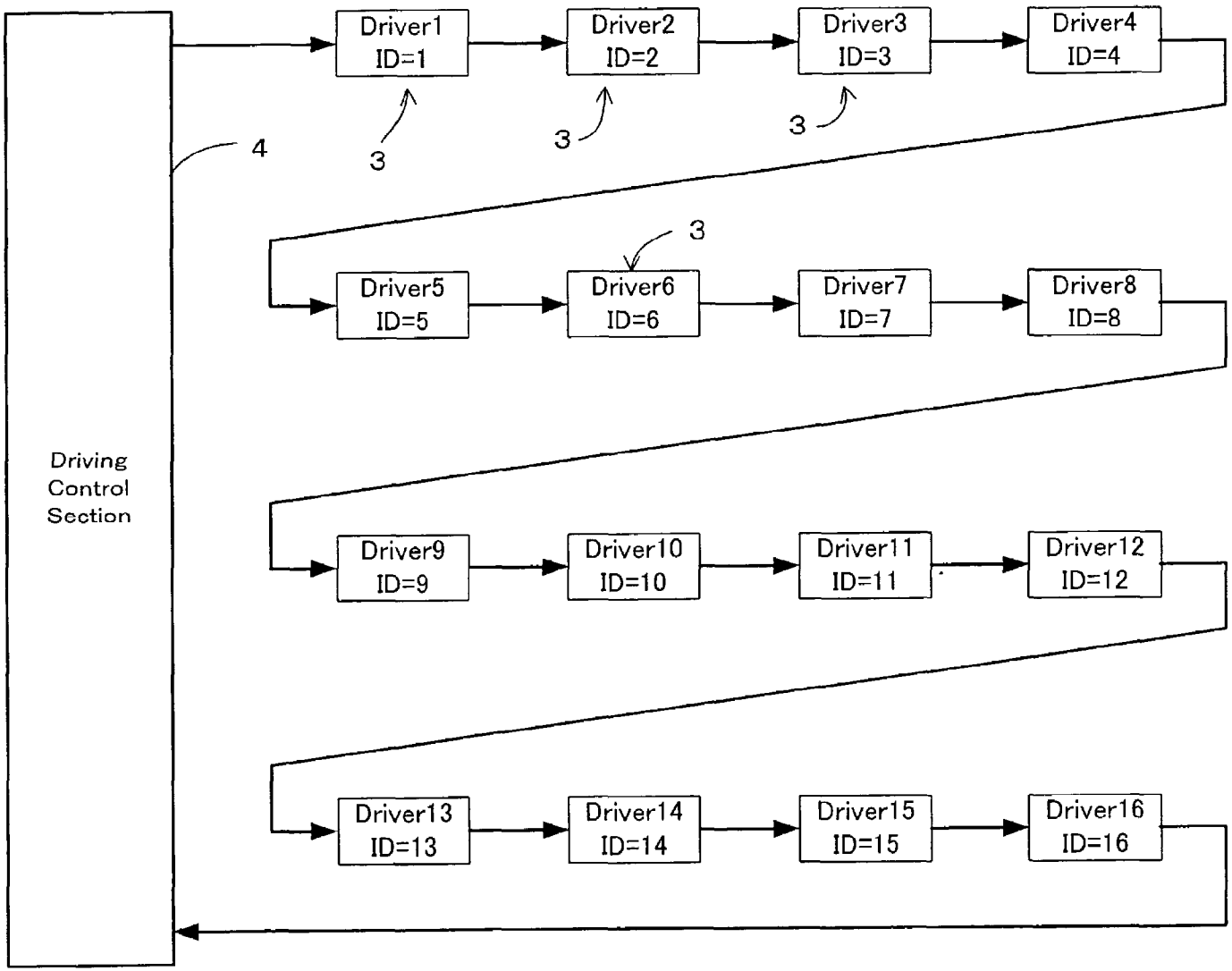
FIG. 21 is a schematic diagram showing horizontal driving sections connected in Z-shape.
Figure 22:
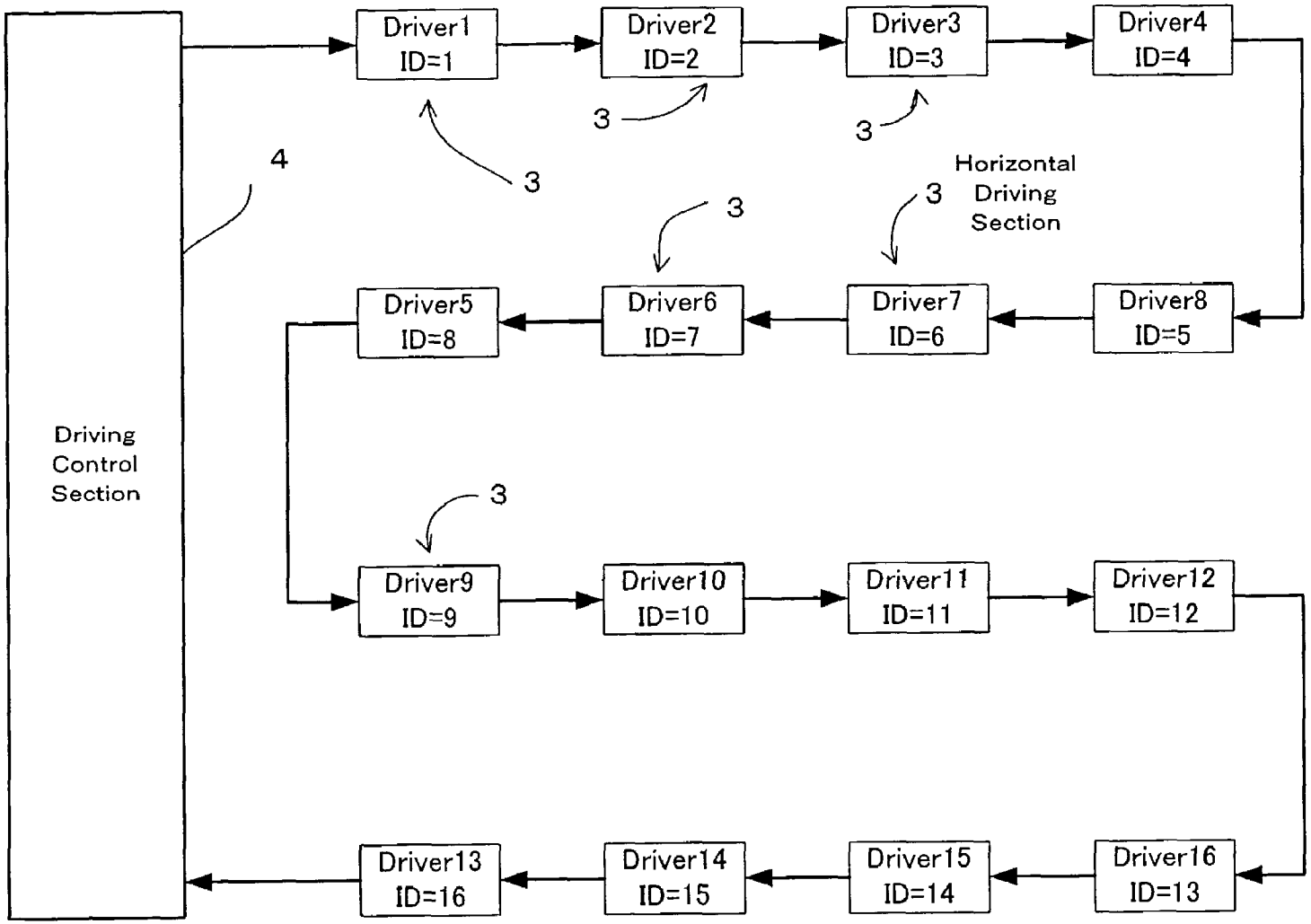
FIG. 22 is a schematic diagram showing horizontal driving sections connected in S-shape.

For example, in an embodiment of FIG. 22, although the data is forwarded in order of connecting the horizontal driving sections 3 by the wire, the order does not correspond with the horizontal driving sections 3 disposing order in the display section. As shown in FIG. 22, although 1–16 of the horizontal driving section 3 are disposed from left top toward in horizontal direction in each row, a signal line connecting order is not the horizontal driving sections 3 disposing order, thus is not a Z-shape shown in FIG. 21 but an S-shape shown in FIG. 22. Accordingly, they are not disposed in one forward direction such as from left to right shown in FIG. 21, but in an S-shape, which is an alternate forward direction such as changing right-and-left toward by turns. Thus, the horizontal driving sections 3 are connected from left to right in one row, and from right to left in next row, to reverse forward direction in each row one after another.

By this way, the wire connecting the horizontal driving sections 3 is not required to extend from the horizontal driving section positioned at an end of one row to the horizontal driving section positioned at a start of a next row. Therefore, it has advantages that are not only low-cost, simplifying product process, but also reducing noise, deformation, reflection or the like caused by extending the signal line.

Thus, in the invention, to denote destination of the data, the data is not always required to transfer corresponding to wire connecting order. Accordingly, connecting is relatively flexible, which is not the prior disposing such as an unvaried one forward direction disposing, achieves a lot of merits such as wiring the signal line easily, shortening total length of the signal line and so on.

EMBODIMENTS

Embodiments of the present invention are described below; additionally, the present embodiment is illustrative and not restrictive.

Figure 2:
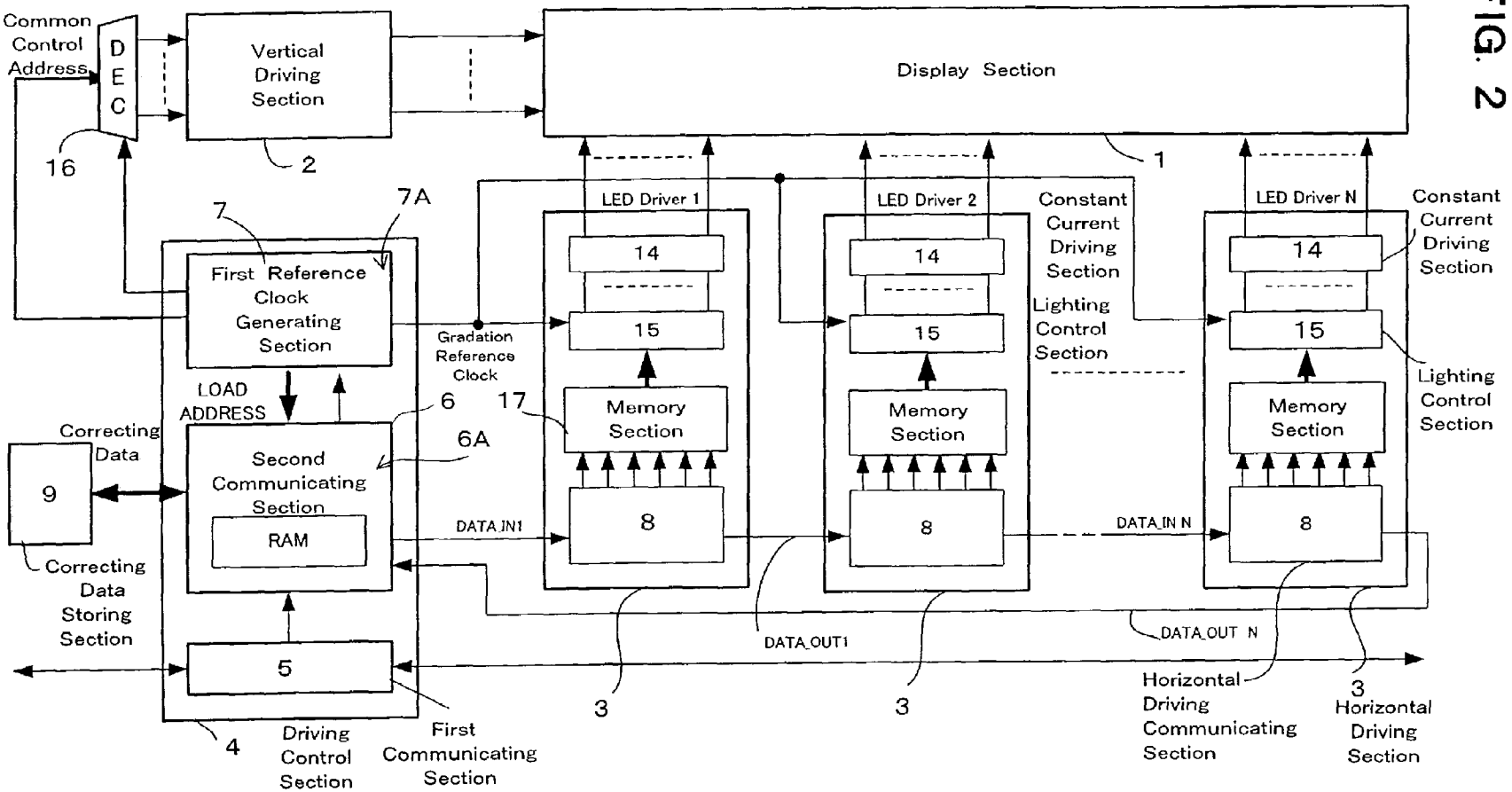
FIG. 2 is a block diagram showing an embodiment of a driving circuit of a display apparatus of this invention.

FIG. 2 is a schematic block diagram showing an embodiment of a display apparatus of this invention. The display apparatus shown in FIG. 3 has (a) a display section 1 disposing a plurality of lighting elements 11 in M rows×N columns of a matrix shape,
(b) a vertical driving section 2 impressing current to each row of the display section 1 with selecting each row,
(c) horizontal driving sections 3 supplying driving current to each column of the display section 1 based on image data corresponding to the selected row,
(d) a driving control section 4 with a first communicating section 5, a second communicating section 6, and first reference clock generating section 7, and
(e) a correcting data storing section 9 storing correcting data for correcting.

Each constituting element is controlled by the driving control section 4. Regarding data from an external controller supplying the image data, the display apparatus receives only data controlling the display apparatus, generates signals required to drive internal of a display apparatus autonomously in an internal display apparatus, and performs light displaying. The driving circuit of this embodiment employs a system to drive the lighting elements with current control.

The display section 1 disposes a plurality of the lighting elements 11 in M rows×N columns of a matrix shape on a substrate formed conductive patterns. LEDs, EL, PDP and so on can be applied to the lighting elements. In this embodiment, each of LEDs, which can emit in red, green blue (RGB), is disposed adjacently by three of the LEDs as one unit to constitute one pixel. The LEDs disposed adjacently of each pixel can represent in full-color or multicolor. The invention is not restricted to this constitution, they can be disposed by two colors adjacently, or one pixel can be disposed two or more LEDs per one color, or the number of LEDs can be changed corresponding to the color.

The LEDs can employ various semiconductors lighting device, which can emit. The semiconductor can employ a semiconductor such as GaP, GaAs, GaN, InN, AlN, GaAsP, GaAlAs, InGaN, AlGaN, AlGalnP, InGaAlN and so on as a light-emitting layer. Further, structure of the semiconductor can employ MIS junction, PIN junction, homo structure or hetero structure or double hetero structure with pn junction.

Light wavelength of the semiconductor device can be selected from ultra-violet ray to infrared ray by selecting a semiconductor material or a mix crystal ratio. Further, the light-emitting layer can be a thin layer such as a single quantum well structure or a multi quantum well structure.

The LED can employ not only RGB primary colors emitting device but also LED mixes ray from an LED and phosphor emitting excited thereby. In this case, using YAG: Ce phosphor etc. converting to long wavelength with being excited by ray from an LED can achieve the LED with one kind of LEDs, whose color tones such as white etc. are good linearity.

Further, the LED can employ various shapes. For example, a bullet type molding an LED chip connected with leads electrically by a mold resin, a chip type LED, or light-emitting device itself can be applied to the LED.

The driving control section 4 has the first communicating section 5, the second communicating section 6, and the first reference clock generating section 7. The first communicating section 5 communicates various data with the external controller or the other display apparatus connected next, and further commands to the second communicating section 6. The second communicating section 6 corrects the image data input (IMDATA) from the external corresponding to dispersion of lighting device characteristics every pixel, and outputs to the horizontal driving section 3. Besides, the horizontal driving section 3 has a horizontal side communicating section 8 to perform a receiving process with the second communicating section 6.

In FIG. 2, the second communicating section 6 corresponds to a DMA control section 6A. The DMA control section 6A, which is the second communicating section 6, has a memory (RAM) to store the image data temporarily. Further, to communicate much data fast, the DMA control section 6A reads contents of the RAM directly by hardware, and transfers the data to the horizontal driving sections 3.

The first reference clock generating section 7 performs current source switching of the vertical driving section 2 by each row. Further, it works as a timing generating section 7A to generate a gradation reference clock, which is a first reference clock to control light gradation. The gradation reference clock is transferred from the timing generating section 7A to each horizontal communicating section 3. Here, in this embodiment, the first reference clock generating section 7 is arranged in the driving control section 4 to transfer the gradation reference clock, the first reference clock generating section 7 can be arranged in the horizontal communicating section 3 side to generate timing autonomously.

The driving control section 4 further has an image data correcting section and an image data storing section. The image data input from the external is corrected corresponding to dispersion of lighting elements 11 by pixel in the data correcting section, and is output from the DMA control section 6A to each horizontal driving section 3. Correcting data for the correcting is stored in the correcting data storing section 9. The image data correcting section reads information data for the correcting from the correcting data storing section 9, and performs data correcting. The correcting data storing section 9 is constituted by a memory device such as a ROM, or preferably an EEPROM.

The correcting data correcting dispersion by lighting elements 11 is stored in the correcting data storing section 9. The correcting data storing section 9 is constituted by a ROM to store correcting data calculated precedently. Although the image data correcting section and the correcting data storing section 9 are arranged individually in the driving circuit shown in FIG. 2, they can be assembled into the driving control section 4. The correcting data includes luminance correcting data for correcting luminance by each lighting element, and luminance correcting data for correcting plate luminance dispersion when using a plurality of the display apparatuses with being assembled, and so on.

A connecting section, which is a physical interface, is a means for transferring data from the controller to the LED units serially, and can be connected electrically by a wire, or can transfer with optical communicating by an optical fiber, with wireless communicating by a electromagnetic wave, infrared radiation, or the like. With wiring, the connecting section can be constituted by two kinds of connecting wires, which are a data line and a strobe line preferably.

The vertical driving section 2 is a common driver impressing current toward a row direction in the display section 1, and constituted by a semiconductor switching device etc. In FIG. 2, one vertical driving section 2 switches a common line of each row in a predetermined order, and impresses current. Besides, a plurality of the vertical driving sections 2 can be employed. The vertical driving section 2 can select one row or a plurality of rows of the display section 1 at one operation.

A plurality of the horizontal driving sections 3 is connected as shown in FIG. 2. LED driver, which constitutes each horizontal driving section 3 by columns of the lighting elements 11, is connected. N columns of the LED drivers 1–N are connected serially. The LED driver is connected electrically with the adjacent LED driver by each horizontal side communicating section 8. This connecting is not restricted by electrical connecting also, can employ optical communicating, or other communicating ways, or combination of them.

The horizontal driving section 3 is constituted by the horizontal side communicating section 8, a memory section 17, a lighting control section 15, and a constant current driving section 14. The memory section 17 is constituted by a shift resister etc. The horizontal driving section 3 is connected with LEDs disposed in a column direction, and supplies current to LEDs of a vertical direction with synchronized switching by the vertical driving section 2 one after another, and performs dynamic lighting. The horizontal driving section 3 is constituted by a semiconductor switching device or a driver IC.

The horizontal driving section 3 has the horizontal side communicating section 8. The horizontal side communicating section 8 communicates with the driving control section 4 or the horizontal side communicating section 8 arranged in the next horizontal driving section 3. Further, the horizontal side communicating section 8 writes data transferred from the DMA control section 6A of the driving control section 4 into the memory section 17 arranged in the horizontal driving section 3. In the embodiment of FIG. 2, the DMA control section 6A transfers image data to the memory section 17, the memory section 17 retains image data by a shift resister. Each horizontal driving section 3 is constituted to be allocated identification information 23 individually, and is transferred image data etc, added the identification information 23 of destination horizontal driving section 3 from the driving control section 4 of the display apparatus. After confirming the data for itself, the horizontal driving section 3 performs a receiving process.

Besides, the driving control section 4 has the first communicating section 5. The first communicating section 5 receives control data from the external controller transferring data for image displaying, commands to the DMA control section 6A of the driving section 4 to perform writing and reading of the memory, the resister etc. For example, when the first communicating section 5 receives image data from the external controller and rewrites a RAM for storing image data in the DMA control section 6A, image displaying is renewed. The control data of the display apparatus can include a process for control of the driving circuit, temperature information of internal display apparatus, monitoring information of source voltage, detecting disconnection between the displaying device and driving circuit, disturbance caused by extraordinary high temperature of the horizontal driving section 3, confirmation of defective signal pattern wiring or data communicating status between the control section and the horizontal driving section 3, writing luminance correcting data, detecting deterioration or damage of the individual lighting element or the like. The first communicating section 5 communicates this data with the external controller and the display apparatuses according to a predetermined communicating method.

The DMA control section 6A transfers data such as the image data, luminance correcting data or the like in predetermined format to the horizontal side communicating section 8 fast by hardware autonomously. Especially, the display unit using LEDs requires four times or sixteen times faster image refresh rate than image refresh rate of normal video rate. Therefore, in dynamic driving, the image data or the luminance correcting data are required to be read with a direct hardware process, and transferred fast.

Figure 3:
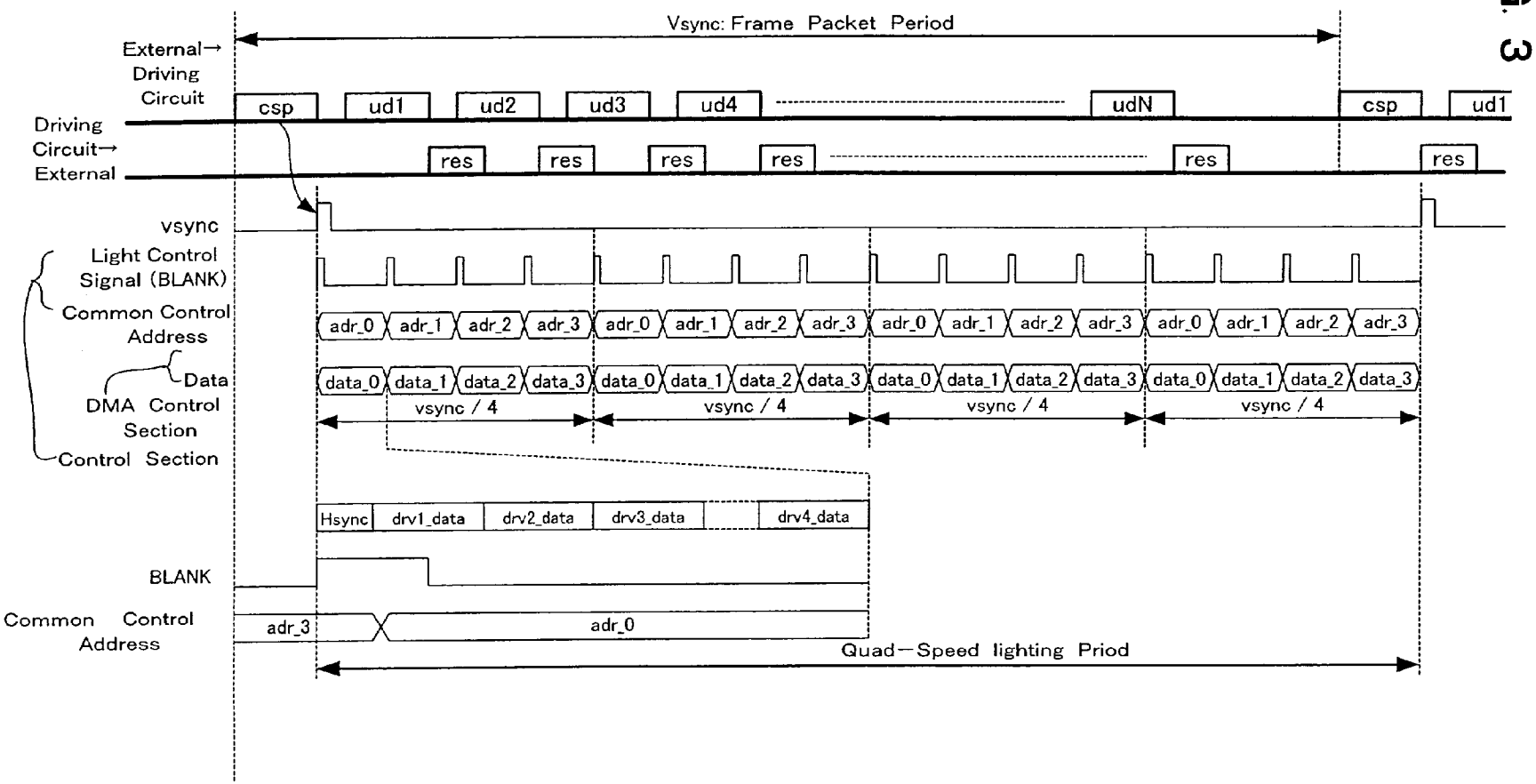
FIG. 3 is a timing chart showing a frame cycle operation of the driving circuit of FIG. 2.

FIG. 3 shows a timing chart of a frame cycle operation in ¼ duty. This embodiment shows a method communicating with adding the identification information 23 to the horizontal driving section 3, and with writing to the memory in the horizontal driving section 3 and synchronizing control from the external controller by packet format. An identifying ID 23*a* as the added identification information 23 is an individual identifying number of IC, which constitutes each horizontal driving section 3, for example. In FIG. 3, a packet for vertical synchronization detecting and each of control data packets corresponding to 1–N of the horizontal driving sections are explained as "csp" (Cycle Start Packet) and "ud1"–"udN" respectively, which are signals transferred from the external controller to the display apparatus. Besides, a response packet transferred from the horizontal driving section 3 to the external controller is explained as "res". Here, this embodiment employs a full-duplex bidirectional operation, also a semi-duplex bi-directional operation can achieve similar method.

The control data transferred from the DMA control section 6A to the horizontal driving sections 3 in the display apparatus are explained as "data_0"–"data_3". Further, "vsync" is generated in the display apparatus corresponding to the data for vertical synchronization detecting "csp". This data determines a packet transferring period of each frame data, and is used as a latch trigger of data.

The driving control section 4 receives data for vertical synchronizing detecting "csp" transferred from the external controller, and recognizes a head of image frame data, and performs vertical synchronizing. As this synchronizing detecting, a lighting control signal (BLANK), a vertical driving section control address in the display apparatus are generated based on predetermined multi-speed displaying. FIG. 3 shows an embodiment of quad-speed lighting in 60 Hz vertical synchronizing period, accordingly one vertical driving period for displaying one screen of one display apparatus is 240 Hz. In this case, the driving duty ratio against one frame packet period (approximately 16 ms) of 60 Hz vertical synchronizing period is ¼, and four common line control periods. In this embodiment, multi-speed displaying is variable, so that a refresh rate variable function is achieved. Further, various data such as image data, luminance correcting data or the like, transferred as N packets (ud1–udN), which is number of the horizontal driving section to be controlled, in one period of data for vertical synchronizing detecting "csp". After receiving this data, each horizontal driving section 3 operates based on the received data in a next vertical period. Therefore, in receiving various data, the received data written into the memory in each horizontal driving section 3, displaying image data is based on the data received in last vertical period.

Figure 4:
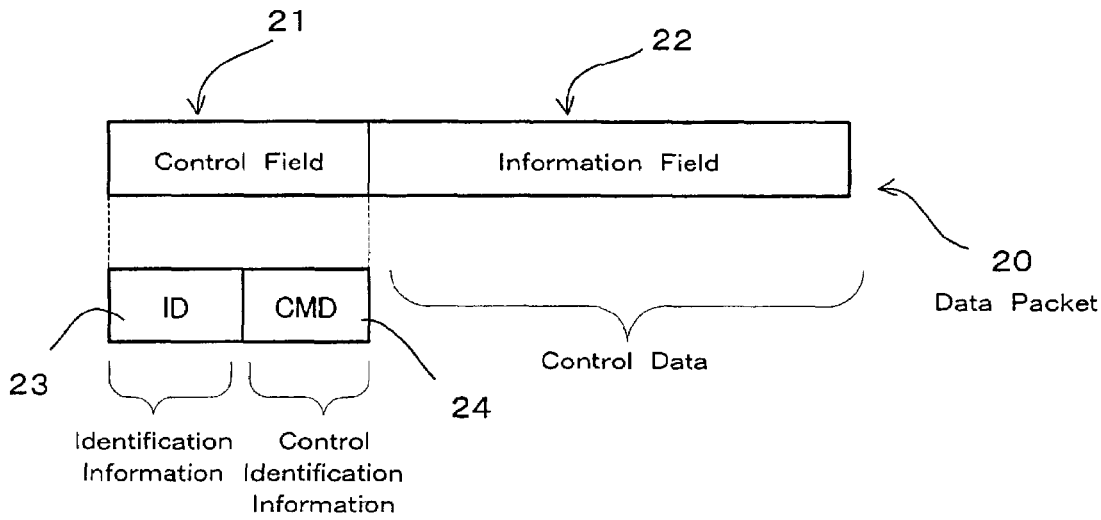
FIG. 4 is schematic diagram showing a constitution of a data packet.

FIG. 4 shows a constitution of a data packet, which is a transferred data formatted in packet format, when the DMA control section 6A, or the second communicating section 6, controls each horizontal driving section 3. The data packet 20 of this format has a control field 21 and an information filed 22, further the control field 21 is divided into the identification information 23 (ID section) and control identification information 24 (CMD section).

The control field 21 is a section storing various identification information added to actual data. The identification information 23 denotes information to discriminate each horizontal driving section 3. In other words, accordingly each horizontal driving section 3 is added the identifying ID as identification information individually, this information denotes destination of the transferred data.

The control identification information 24 is information denoting control type, which denotes how control is performed to the horizontal driving section 3. The type of the data includes a horizontal synchronizing signal (HSYNC) data, the image data, gradation data, luminance adjusting data, rewriting luminance correcting data, reading disturbance data, and so on.

The control field 22 denotes contents of the control data, which is actual data corresponding to the control identification information 24 of the CMD section. Therefore, individual control of every horizontal driving section 3 can be achieved.

The data packet can include not only for an individual horizontal driving section 3 such as the image data, but also data for all of the horizontal driving sections 3. The data packets transferred to all of the horizontal diving sections 3 are HSYNC, automatic ID adding command and so on. These data packets are set common ID 23B as the identification information 23.

Figure 5:
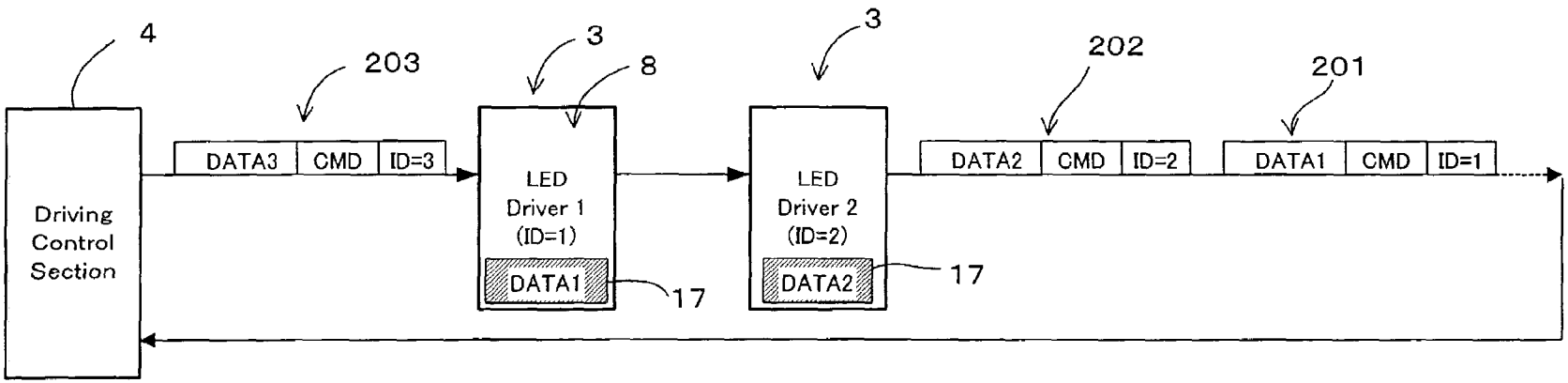
FIG. 5 is a block diagram showing a communication status (a communication path) of a data packet (packet formatted data).

FIG. 5 is a block diagram showing a communication status, in which the driving control section 4 transfers data packets 20 of the format of FIG. 4 and the horizontal driving sections 3 receives them. In this embodiment, a plurality of the horizontal driving sections 3 are connected with the driving control section 4 serially. Each of the horizontal driving sections 3 has one input and one output, and connected with between the second communicating section 6 of the driving control section 4 and the horizontal side communicating section 8 of the horizontal driving section 3, or between the horizontal side communicating sections 8 of the horizontal driving sections 3. The data packets 201, 202, 203 output from the driving control section 4 can be transferred to all of the horizontal driving section 3 transparently.

In this embodiment, data communicating is performed only in one direction. In FIG. 5, the horizontal side communicating section 8 of the horizontal driving section 3 can output data only in one direction. A plurality of the horizontal driving sections 3 connected serially are connected via the driving section 4 control in a loop shape. Accordingly, the data packet 20 output from the second communicating section 6 of the driving control section 4 is transferred to each horizontal driving section 3 round transparently, then the data packet 20 output from the horizontal driving section 3 connected at the lowest stream of the transferring direction is input to the second communicating section 6 of the driving control section 4. Thus, the data packet 20 output from the second communicating section 6 of the driving control section 4 comes full circle to the driving control section 4 around each horizontal driving section 3 in a loop shape. The driving circuit of the invention can be constituted with bi-directional communicating.

In the case that identification information 23 is set to each horizontal driving section 3, each horizontal driving section 3 monitors the ID, which is identification information 23 of the data packet 20. When value of the ID agrees with its own identifying ID 23*a*, each horizontal driving section 3 stores the added packet data into the memory section 17 of the internal driving device. In FIG. 5, the driving control section 4 transfers data packets 201, 202, 203 to the horizontal driving sections 3 one after another. When data packet 201 passing through, the horizontal driving section 3 (LED Driver 1), which is "ID=1", performs a receiving process and stores "DATA1" into the memory section 17. When data packet 202 passing through, the horizontal driving section 3

(LED Driver 2), which is "ID=2", performs a receiving process and stores "DATA2" into the memory section 17.

Figure 6:
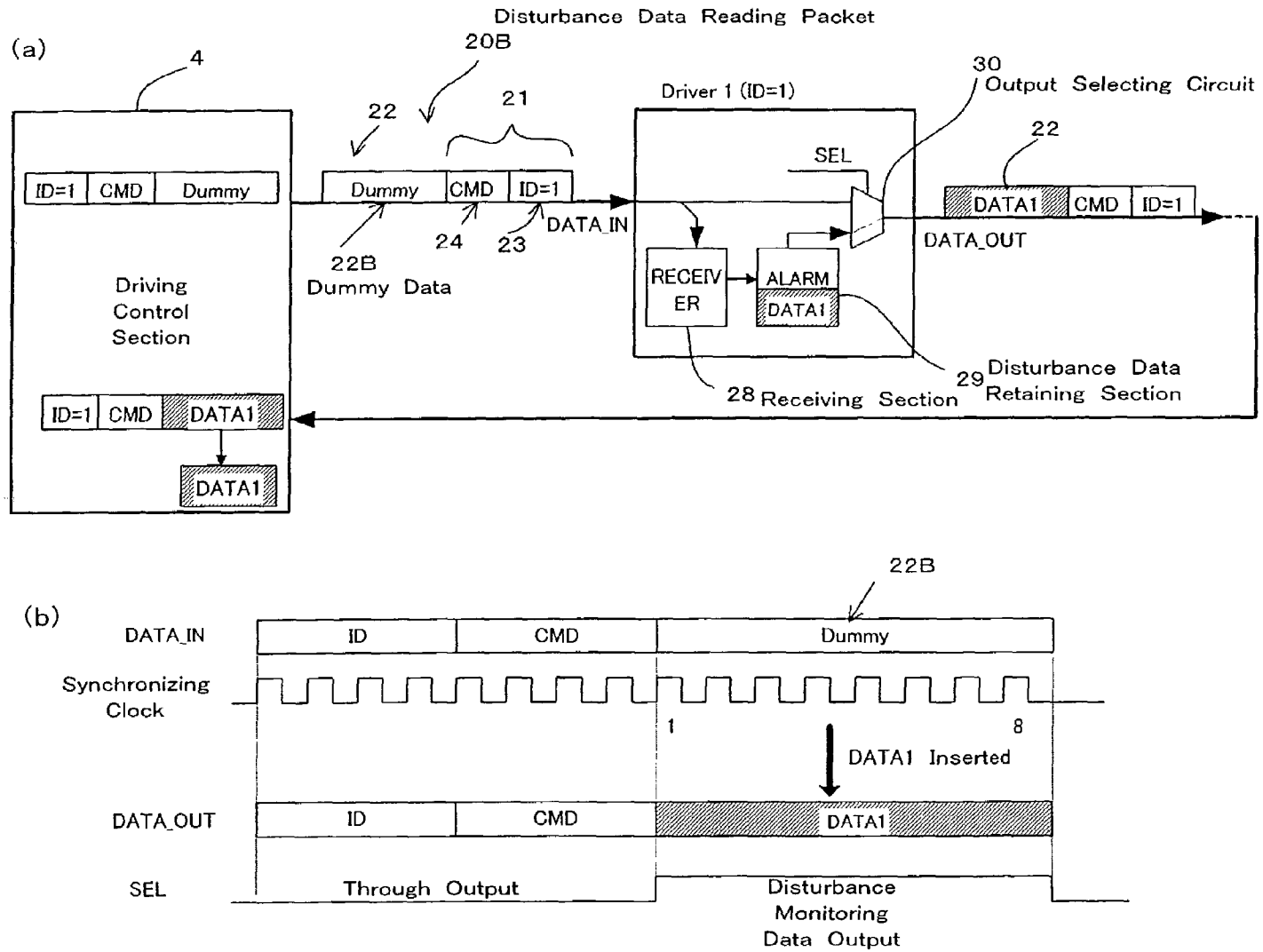
FIG. 6 is a block diagram showing a disturbance monitoring data reading status.

FIG. 6 shows a method reading disturbance data with controlling the horizontal side communicating section 8 of the horizontal driving section 3. To explain briefly, although a plurality of the horizontal driving sections 3 are ordinary connected, this figure shows that disturbance data reading packet 20B is transferred to only one horizontal driving section 3.

As shown in FIG. 6(*a*), the horizontal side communicating section 8 of the horizontal driving section 3 has a receiving section (RECEIVER) 28 performing a receiving process, a disturbance data retaining section 29 retaining disturbance data of the horizontal side communicating section 8 itself, an output selecting circuit 30 outputting data alternatively via the receiving section 28 or data input into the horizontal side communicating section 8 directly. The horizontal driving section 3 with this structure outputs a control field 21 of the input data packet from the output selecting circuit transparently. Besides, it can output the information field 22 with converting data. For example, when a particular data packet is input, it discriminates control field 21 of the data packet, and outputs with converting data included in the information field 22 of the data packet into predetermined data.

When reading the disturbance data, the driving section 4 transfers the disturbance data reading packet 20B to the horizontal driving section 3 instead of ordinary data packets. The disturbance data reading packet 20B shown in FIG. 6(*a*) has "ID=1" as the identification information 23 in the control field 21, disturbance data command as control identification information 24, and dummy data (DUMMY) 22B as the information field 22 with inserted. The dummy data 22B is data pattern to obtain synchronizing clock. As shown in FIG. 6(*b*), after receiving the disturbance data reading packet 20B output from the driving section 4 to the horizontal driving section 3, which is "ID=1", the horizontal driving section 3 generates synchronizing clock inside based on the data packet including dummy data 22B.

After confirming "ID=1" in the identification information 23, the horizontal driving section 3 receives the data packet, and checks contents of the control identification information 24 (CMD). The horizontal side communicating section 8 receiving disturbance reading of the control identification information 24 changes a selecting signal of the output selecting circuit (SEL) 30 from the through output to the disturbance monitoring data output. Therefore, the disturbance monitoring data ("DATA1" shown with oblique in FIG. 6 (a)) retained in the disturbance data retaining section 29 in the horizontal driving section 3 is inserted into the information field 22 of the disturbance data reading packet 20B, then output with converting the dummy data 22B. The output data is transferred back to the driving control section 4 with replacing as shown in FIG. 6(*b*). The driving control section 4 abstracts the control field 22 of the disturbance data reading packet 20B, then transfers the data to the external controller for reading the disturbance monitoring data.

FIG. 7 is a block diagram showing an operation of a packet data transferring circuit arranged in the driving control section 4. The circuit shown in this figure converts the transferring data into the format of the data packet shown in FIG. 4 with proceeding as described below.

The DMA control section 6A is the second communicating section 6 controlling each horizontal driving section 3. The DMA control section 6A is connected with an identification information storing section 25 and a control identification information storing section 26. The exemplary identification information storing section 25 of FIG. 7 is constituted by an ID resister. Further, the control identification information storing section 26 is a CMD control controlling the identification information 24.

The identification information storing section 25 stores an adding order of the identification information 23 corresponding to a connecting form of all of the horizontal driving sections 3 connected with the driving control section 4 to be able to set transferring the identification information 23 spontaneously. Reading is performed sequentially. The control identification information storing section 26 outputs the identification information 24 corresponding to data of each information field 22. The data to be inserted into the information field 22 includes the image data, the luminance correcting data, driver control data and so on. Various data to be inserted into the information filed 22 is output with selecting data corresponding to the control identification information 24 via a selecting circuit (SEL) 31. The identification information (ID) 23, the control field 21 of the control identification information (CMD) 24, and data (DATA) of the information field 22 are multiplexed by a multiplex circuit (MUX) 32, then converted into the data packet 20 of the data packet format of FIG. 4, and transferred to the horizontal driving sections 3.

Figure 8:
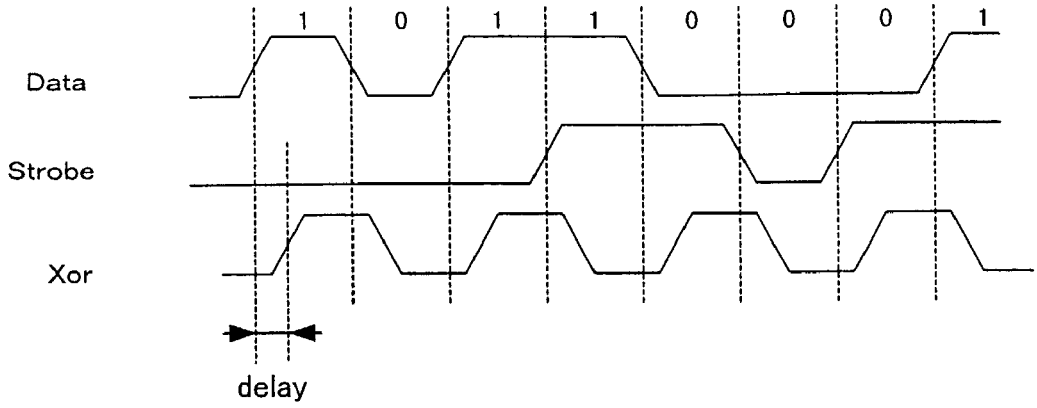
FIG. 8 is a block diagram showing a data strobe encoding system.
Figure 8:
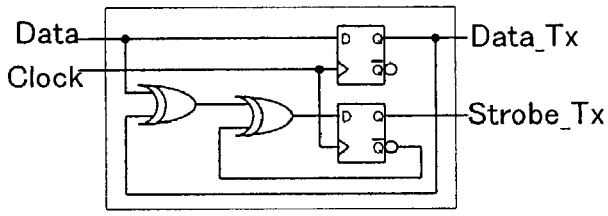
Figure 8:
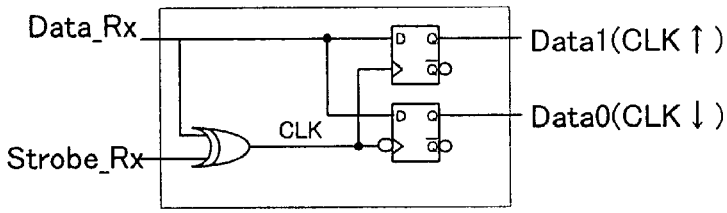

FIG. 8 shows a data strobe (DS) encoding system applied to data communicating between the DMA control section 6A and the horizontal side communicating section 8. In this embodiment, the packet data is communicated with converted into serial data and with DS-encoded to reduce signal line number as less as possible. In DS-encoding, receiving clock synchronizing data can be generated by a decoding circuit arranged in the horizontal driving section 3 with XOR operation of a data (Data) signal and a strobe (Strobe) signal. In this figure, FIG. 8(*a*) shows each waves generated by the DS-encoding system, i.e. a data signal wave, a strobe signal wave, and the receiving clock generated by XOR operation of them. The generated receiving clock slightly occurs a delay (delay) by a XOR circuit. Further, FIG. 8(*b*) shows an exemplary DS-decoder and an exemplary DS-decoder respectively.

When supplying clock signal synchronizing with data by another line to each horizontal driving section 3, as increasing number of the connected horizontal driving section 3, the clock signal pattern on the substrate is extended, so that deformation of the pulse form cause of reflection is increased, and it becomes radiation noise source. By the DS-encoding, the synchronizing clock can be generated in the receiving circuit side, and influences such as deformation of the clock caused by reflection etc. can be reduced.

Figure 9:
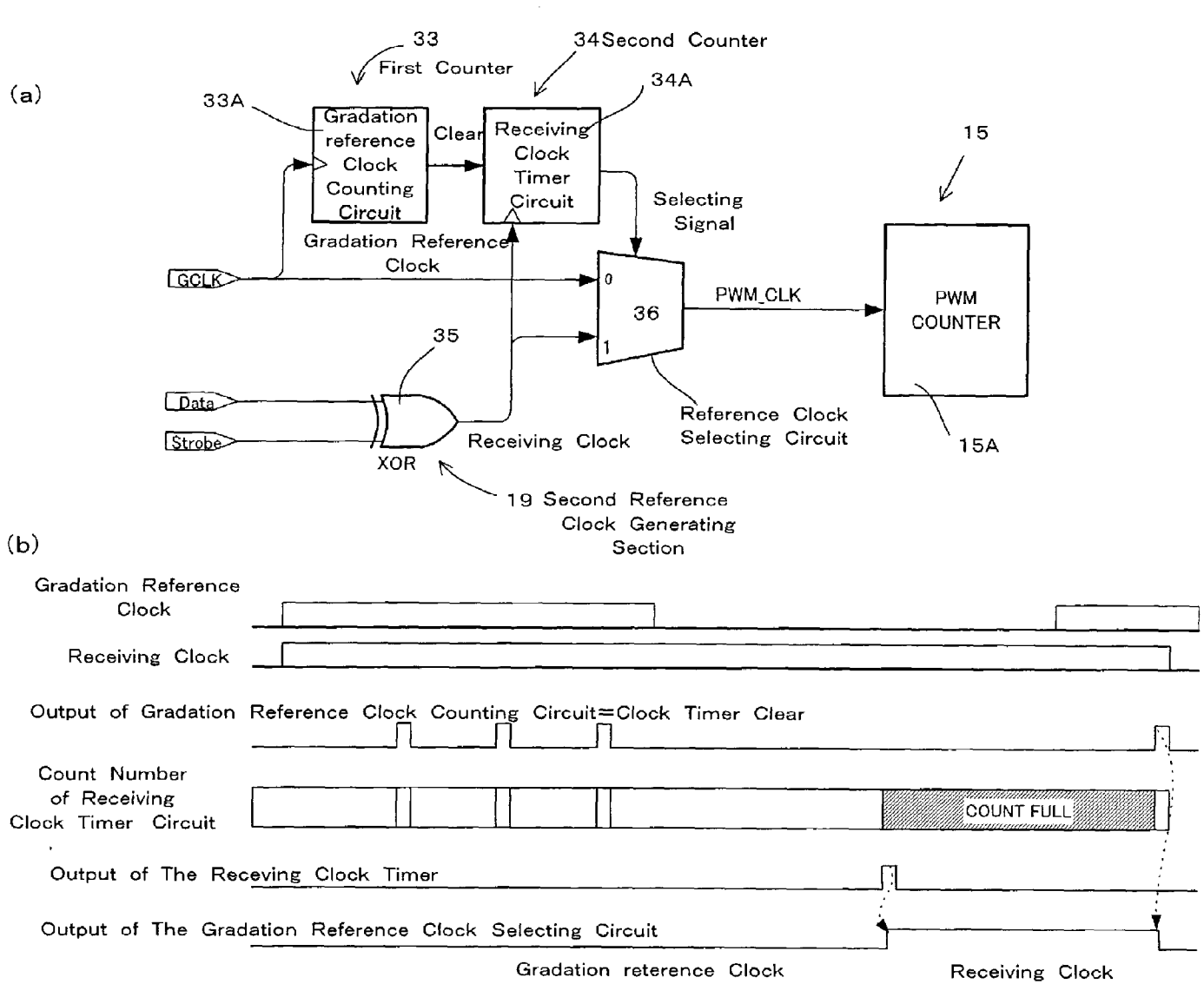
FIG. 9 is a block diagram showing an example of a reference clock switching circuit.

FIG. 9 shows an exemplary gradation reference clock (GCLK) selecting/switching circuit using data communication by encoding. Generally, to perform a gradation control, a gradation reference clock should be provided to each horizontal driving section 3 when driving the lighting elements such as LEDs. Pulse frequency modulation of the gradation reference clock can perform gamma correcting of image display etc. Further, frequency of the reference gradation clock can increase and decrease lighting pulse width.

The gradation reference clock is generally provided from external. In this embodiment, the first reference clock generating section 7 of the driving control section provides it. Besides, in the embodiment of FIG. 9, employing data communication system by the DS-encoding can sustain displaying operation with providing gradation reference clock as the receiving clock (RCLK) DS-decoded in the horizontal driving section 3 instead of the gradation reference clock, even if providing the gradation reference clock is stopped by some reasons.

A switching circuit of reference clock is arranged in the horizontal driving section 3. The circuit shown in FIG. 9(*a*) has a gradation reference clock counting circuit 33A, a receiving clock timer circuit 34A, an XOR circuit 35, a reference clock selecting circuit 36, and a pulse modulating circuit 15A.

The reference clock switching circuit shown in this figure controls lighting gradation based on reference clock. The lighting gradation is controlled by PWM control. Therefore, a pulse modulation circuit (PWM counter) 15A is arranged as the lighting control section 15.

Further, the circuit employs the receiving clock synchronizing with various control data input from the driving control section as the second reference clock. A second reference clock generating section 19 generating the second reference clock is constituted by the XOR circuit 35, the receiving clock is generated by XOR of the data signal and the strobe signal.

The reference clock selecting circuit 36 inputs the gradation reference clock as the first reference clock and the receiving clock as the second reference clock, and outputs one of them alternatively as the reference clock to the lighting control section 15.

The gradation reference clock counting circuit (GCLK Counter) 33A constitutes a counting circuit as a first counter 33 employing the gradation reference clock as a clock. As shown in FIG. 9(*b*), the gradation reference clock counting circuit 33A counts input of the gradation reference clock, which is the first reference clock, and generates a clear signal (CLR) every predetermined count number.

Further, the receiving clock timer circuit (RCLK Timer) 34A constitutes a counting circuit as a second counter 34 employing the receiving clock as a clock. It counts input of the receiving clock, which is the second reference clock, until inputting the clear signal from the gradation reference clock counting circuit 33A, which is the first counter 33. When the count becomes predetermined count value as full, a selecting signal (GCSEL) is changed from low level (=0) to high level (=1), as shown in a right side section with oblique of FIG. 9(*b*), for example. Besides, when the gradation reference clock counting circuit 33A inputs the clear signal before the count becomes the predetermined value, a reset signal is input as shown in a left section of FIG. 9(*b*), so that the receiving clock timer circuit 34A is cleared and does not output the selecting signal.

The reference clock switching circuit operates to switch from the gradation reference clock to the receiving clock as below. The clear signal generated in a predetermined period by the gradation reference counting circuit 33A is provided as the reset signal of the receiving clock timer circuit 34A, and resets the timer and the counter. If the gradation reference clock is stopped to be provided by some reasons, the clear signal is not generated, and when the counter value counts predetermined counter value, the selecting signal is input to the reference clock selecting circuit 36 to change from LOW to HIGH or from HIGH to LOW. In this case, the PWM reference clock (PWM_CLK) provided to the pulse modulation circuit (PWM counter) 15A is changed from the gradation reference clock (GCLK) with externally provided to the receiving clock (RCLK). Therefore, the PWM operation is continued, so that the displaying operation is also continued. Thus, when the input from the gradation reference clock is fixed LOW or HIGH, the receiving clock timer circuit 34A becomes full, and the reference clock selecting circuit 36 changes automatically, so that the receiving clock is input.

This structure can use the reference clock generated autonomously by the data signal and the strobe signal as the PWM reference clock, so that displaying is carried on, even the gradation reference clock provided from external of the horizontal driving section is disturbed. Further, in another embodiment, the receiving clock can be used as the reference clock without the gradation reference clock with externally provided. In this case, only two lines for the data signal and the strobe signal can control the signal input/output, so that wiring line number between the driving section and the horizontal driving section can be further reduced. Furthermore, a pulse generating circuit generating the gradation reference clock can be arranged in the horizontal driving circuit as the first reference clock generating section.

Figure 10:
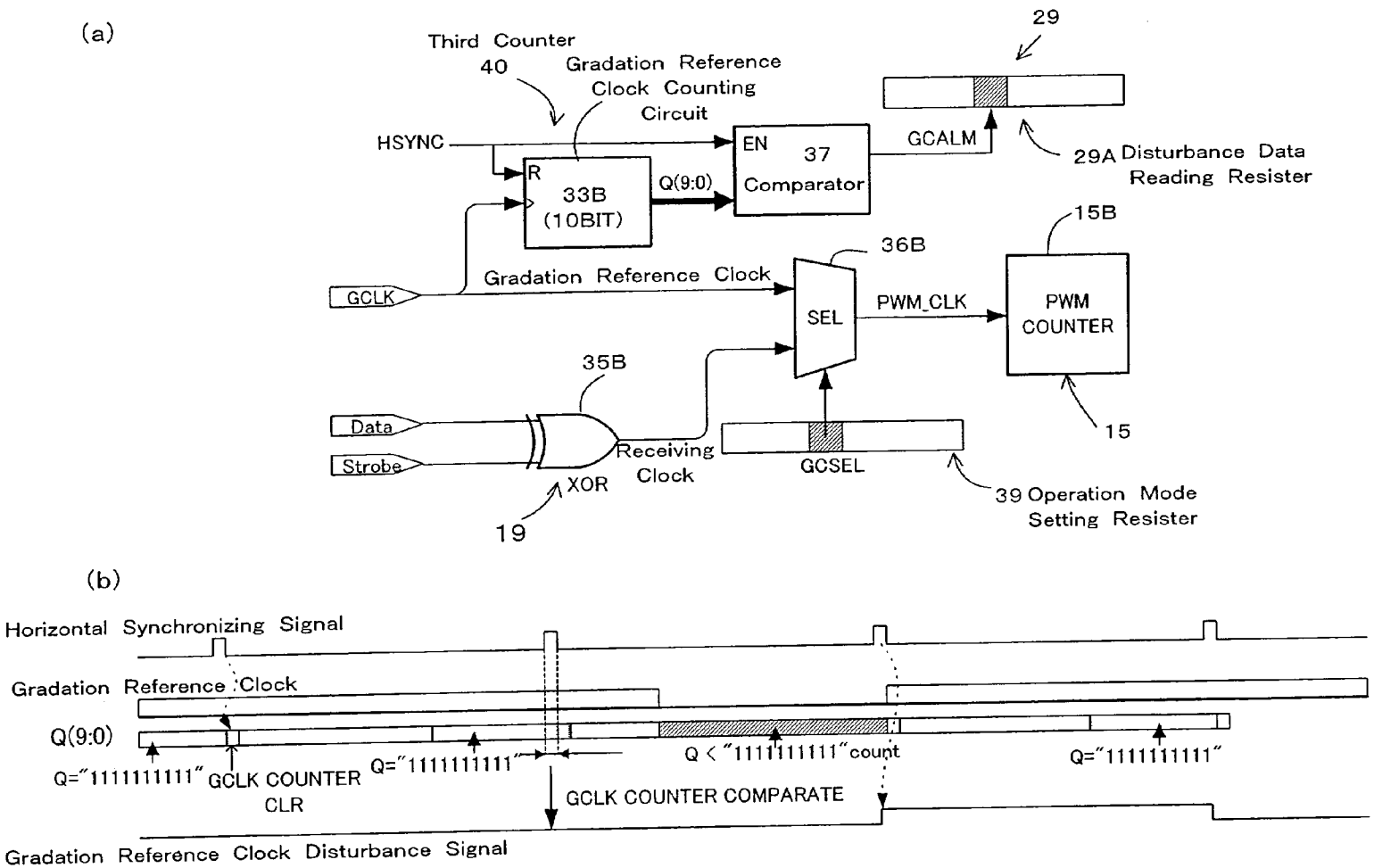
FIG. 10 is a block diagram showing another example of the reference clock switching circuit.

FIG. 10 shows another embodiment of the reference clock switching circuit. In FIG. 9, when the gradation reference clock is disturbed, the reference clock switching circuit selects automatically. In FIG. 10, the driving control section monitors the disturbance of the gradation reference clock, and selects actively when detecting the disturbance.

The switching circuit shown in FIG. 10 is also arranged in the horizontal driving control section. This circuit has a gradation reference clock counting circuit 33B, a comparator 37, a reference clock selecting circuit 36B, and a pulse modulating circuit 15B.

The gradation reference clock counting circuit 33B as a third counter 40 counts input of the gradation reference clock, which is the first gradation reference clock. Then after the counted number of the gradation reference clock becomes a predetermined value, and retains predetermined data, it clears the counted number when receiving the horizontal synchronizing signal denoting start of a frame.

Besides, when the counted number is lower than the predetermined value, a gradation reference clock disturbance signal denoting an occurrence of gradation reference clock disturbance is retained in disturbance data reading resister 29A, which is the disturbance data retaining section 29 arranged in the horizontal side communicating section. In this case, the driving control section reads the disturbance data denoting the occurrence of gradation reference clock disturbance by the disturbance data reading packet 20B, and renews an operation mode setting resister 39, then the reference clock selecting circuit 36B in the horizontal driving section with the occurrence of gradation reference clock disturbance outputs to the pulse modulating circuit 15B with selecting from the gradation reference clock to the receiving clock.

The reference clock selecting circuit 36B shown in FIG. 10(*a*) operates to switch from the gradation reference clock to the receiving clock as below. First, the gradation reference clock counting circuit 33B counts one frame of the gradation reference clock. The count is performed by synchronizing with the HSYNC signal, which is the horizontal synchronizing signal, every one frame as shown in FIG. 10(*b*). When displaying gradation number of the signal data for gradation representing is 10 bit, the gradation representing can be performed in $2^{10}$=1024, which is binary 10 figures. Therefore, 1024 pulses are required to provide in one frame. When the counted number in one frame becomes 1024, i.e. when data transferring completes, the gradation reference clock counting circuit 33B retains predetermined value, "1111111111" for example, in the rest of the period.

Next, when the HYSYC is input as the frame start packet denoting frame synchronizing, the comparator 37 compares output of the counter with "1111111111". The comparator 37 outputs "0" to the disturbance data reading resister 29A arranged in the horizontal side communicating section when the output agrees with "1111111111", and outputs "1" when the output is less than "1111111111". Further, the gradation reference clock counting circuit 33B is reset by input HYSYC, and starts a count operation again.

The driving control section confirms the disturbance data reading resister 29A by the disturbance data reading packet 20B, and outputs "0" to the operation mode setting resister 39 as a gradation reference clock selecting signal (GCSEL) when judging no disturbance, and outputs "1" when judging disturbances, for example. In accordance with the disturbance information, the driving control section 4 controls the reference clock selecting circuit 36B to switch from the gradation reference clock to the receiving clock. The driving control section transfers a data packet to the horizontal driving section with the occurrence of the disturbance commands, accordingly switching the reference clock selecting circuit 36B is performed. The receiving clock is generated by an XOR circuit 35B with XOR of the data signal and the strobe signal, similar to the circuit of FIG. 9.

The reference clock selecting circuit 36B of FIG. 10 can prevent a fault operation, which might be occurred in the circuit of FIG. 9. In the reference clock selecting circuit 36, in the case that the clock frequency is low, when the gradation reference clock counting circuit 33A counts the gradation reference clock, the receiving clock timer circuit 34A might be full before the gradation reference clock counting circuit 33A becomes full, i.e. before the clear signal input to the receiving clock timer circuit 34, so that the selecting signal can be output to the reference clock selecting circuit 36. On the other hand, the reference clock selecting circuit 36B of FIG. 10 does not switch automatically by the timer, but the gradation reference clock counting circuit 33B counts the clock number and confirms that counted number becomes the predetermined value by the comparator 37, so that the operation can be judge correctly whether works properly or not. The driving control section 4 can control the reference clock selecting circuit 36 to switch when abnormal conditions are encountered.

Figure 11:
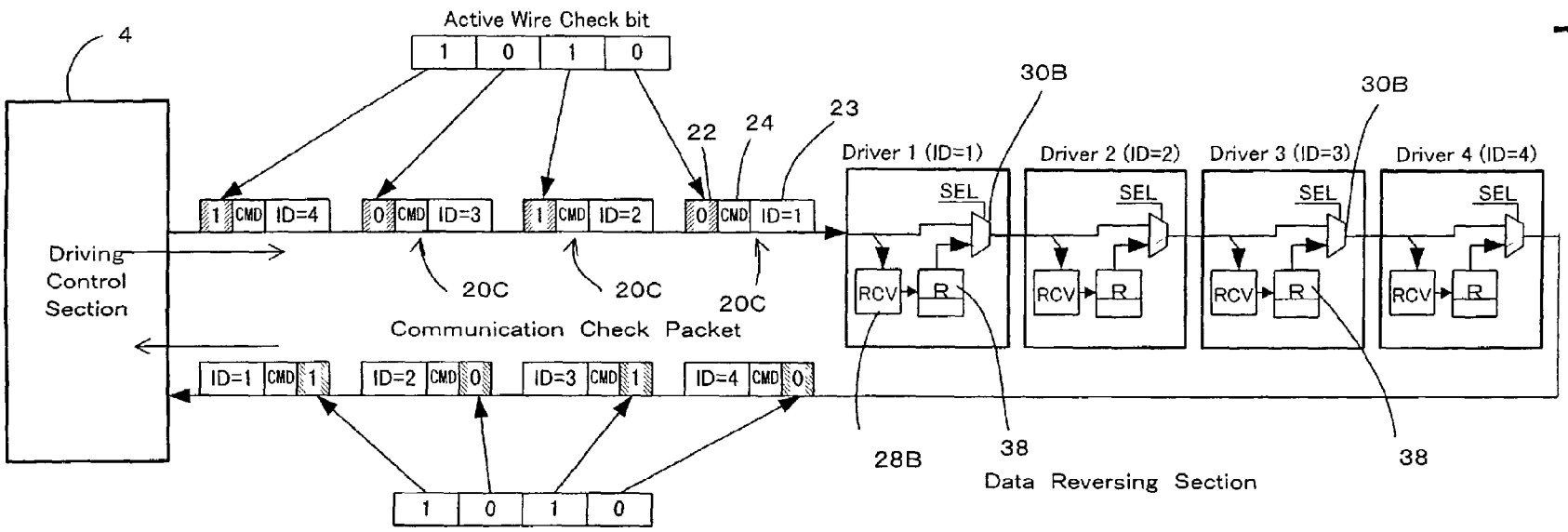
FIG. 11 is a block diagram showing a check status of a communication between a driving control section and each horizontal driving section.

FIG. 11 shows a way to check a status of a data communication between the driving control section 4 and horizontal driving sections 3. The way is for monitoring whether the data communication between the DMA control section of the driving control section 4 and each horizontal driving section 3 is performed properly or not. For example, it is confirmed whether pins of the driver IC are removed or not, whether solder is removed or not, whether a disturbance such as a connecting defect, disconnection or the like is occurred or not. Here, this figure shows four LED drivers, which are the horizontal driving sections 3, in the exemplary embodiment, needless to say, number of the horizontal driving sections 3 is not restricted to this, it can be set less, or more than the number.

The driving control section 4 shown in FIG. 11 transfers the communication check packets 20C as the data packets to each horizontal driving section 3. Four communication check packets are constituted with information field 22, which includes "ID=1–4" as the identification information 23, control field 21 including a command of communication check as control identification information 24, and information field 22 including a communication check data (Active Wire Check bit). The communication check data is bit for communication check, for example. Here, the driving control section 4 inserts bit pattern "0101" as monitoring bit pattern sequence into each of the data packets when transferring. Concretely, the communication check data of the data packet for "ID=1" is inserted "0", further the communication check data of the data packet for "ID=2", "ID=3", "ID=4" are inserted "1", "0", "1" respectively.

When receiving these communication check packets 20C, each horizontal driving section 3 outputs the communication check data with reversing. Therefore, the horizontal driving communicating section 8 has a data reversing section (R) 38 reversing the data of the information field 22. Each horizontal driving section 3 confirms the identification information 23 and the control identification information 24 of the data packets (here, the communication data packets) received in the receiving section (RCV) 28B. When the identification information 23 agrees with individual ID of itself and the control identification information 24 is control type commanding communication check, bit of communication check data reversed in the data reversing section 38 is output by switching an output selecting circuit 30B, accordingly the control field 22 of the communication check packet is replaced with reversing output. Each horizontal driving section 3 outputs the rewritten data packet. The out put data is transferred to the driving control section 4.

The driving control section 4 performs the disturbance check of the communicating status based on the data included in the control field 22 of each communication check packet 20C transferred from each horizontal driving section 3 and the communication check data of the communication check packet 20C transferred to each horizontal driving section 3. When the data communication is performed properly, the monitoring bit pattern sequence "0101" output from the driving control section 4 to each horizontal driving section 3 should be input to the driving control section 4 as "1010" with reversed until back to the driving control section 4, according to result of reversing the communication check data (Active Wire Check bit). To compare these bit patterns, the driving control section 4 can confirm properness of the receiving process of each horizontal driving section 3, properness of pattern wiring of data lines and so on.

Besides, here, in the embodiment, after all LED units receive one common line period of individual control data for LED units, lighting timing of LEDs is performed at the same time in the next common line period, also each LED unit can starts lighting after receiving individual control data for LED units sequently. According to constitution of the invention, the LED lighting apparatus can be large-scale or high fine displaying with relatively easy wiring, and assembling units spontaneously.

Figure 12:
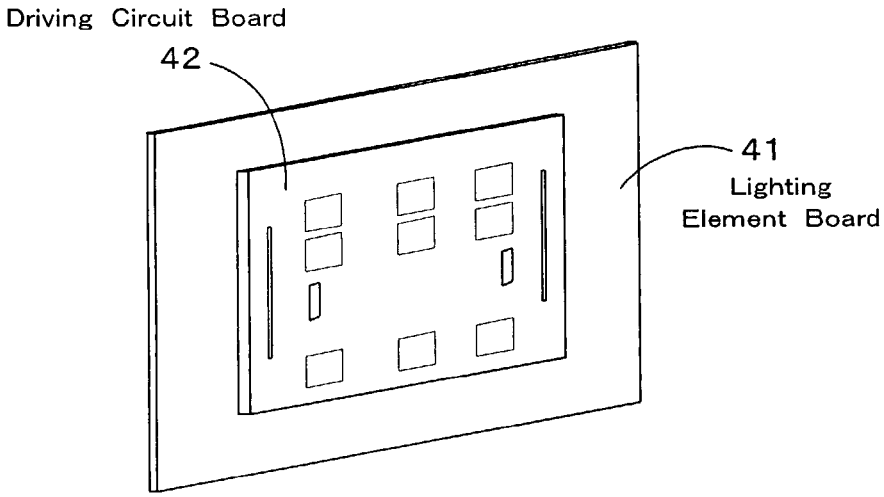
FIG. 12 is a schematic oblique view showing a driving circuit board and a light emitting element panel.
Figure 12:
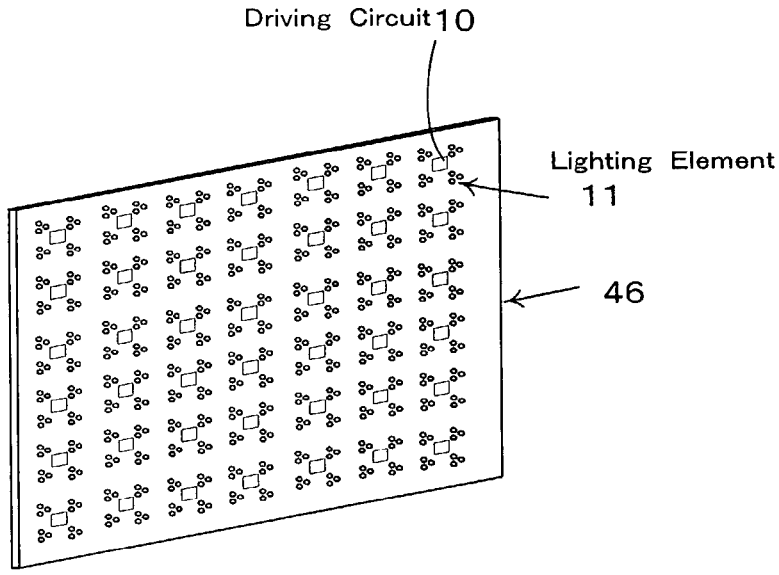

FIG. 12 shows an embodiment of the invention integrally formed with a substrate disposing light emitting elements and a substrate disposing driving circuits. Previously, it was difficult to dispose the driving circuit of the light emitting elements on the substrate disposing the light emitting elements in a matrix shape because of space. Especially, according to an increasing number of the light emitting elements and complicating the driving circuit of the light emitting elements, it is more difficult to dispose the light emitting elements and the driving circuit integrally because of the space. Further, according to an increasing number of the light emitting elements, a number of the signal lines connecting the driving control section and the horizontal driving sections, and among the horizontal driving control sections also increases extremely. Therefore, the substrate disposing the light emitting elements and the substrate of driving circuits are mostly formed as individual substrates, as shown in FIG. 12(*a*). A lighting panel shown in FIG. 12 (*a*) is constituted by a lighting element board 41 and a driving circuit board 42 as individual members. The driving circuit board 42 is arranged with facing to the back of an LED substrate, which is the lighting element board 41, i.e. reverse of a surface disposing the LEDs, which are the light emitting elements, and connected electrically and mechanically by pins.

On the other hand, the display apparatus of the embodiment of the invention communicates between the driving control section and the horizontal driving sections, and among the horizontal driving sections by packet communication with common lines. According to this constitution, wiring signal lines between each member mutually or individual signal lines for each signal is not required. Therefore, the number of signal lines for wiring can be reduced extremely, so that the circuit can be downsized by simplifying wiring. Accordingly, the light emitting elements and the driving circuits can be commonly disposed on one sheet of an integrated substrate 46 as shown in FIG. 12(*b*).

Figure 14:
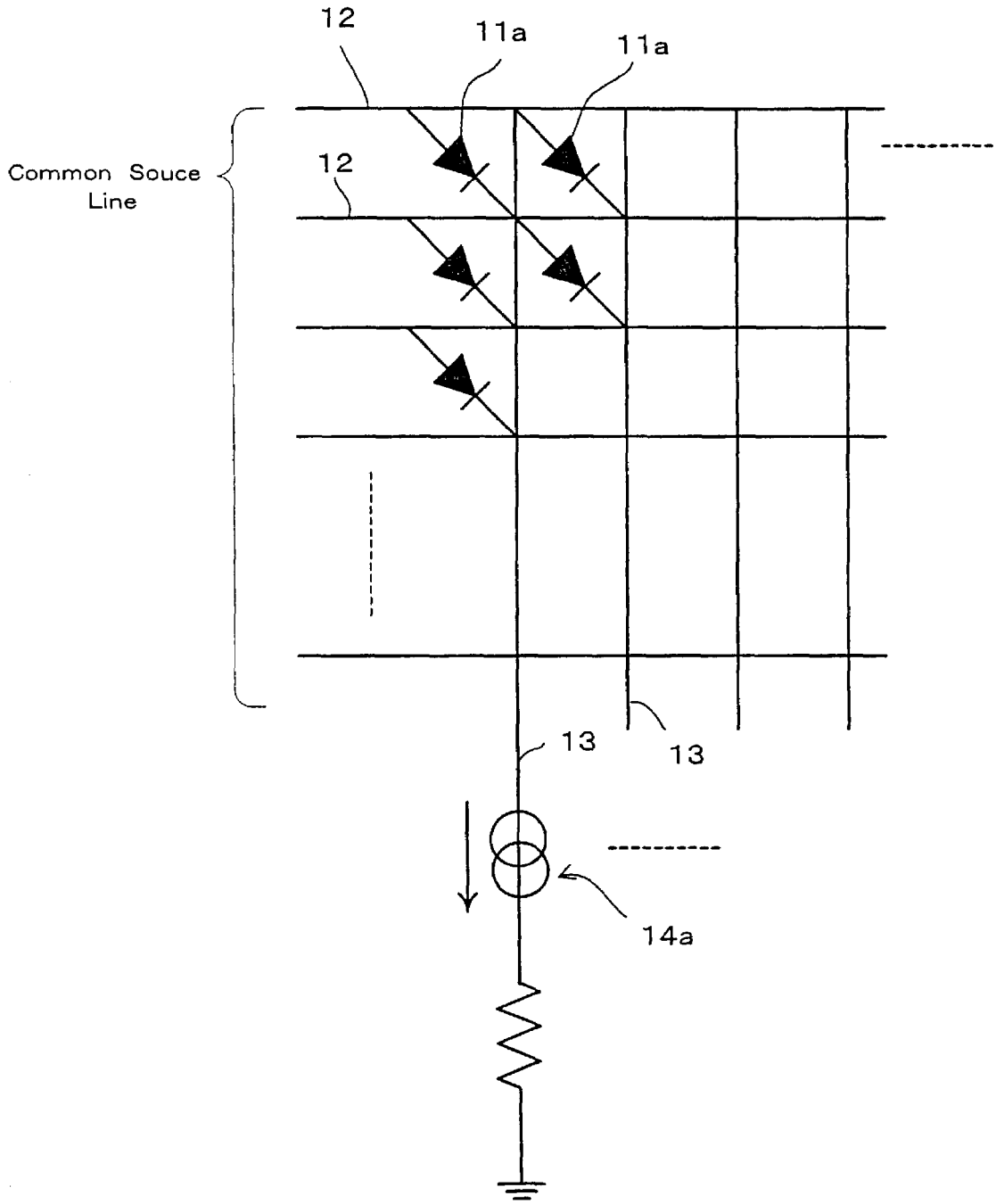
FIG. 14 is a circuit diagram showing a schematic driving system of a display apparatus.

Especially, as the integrated substrate 46 shown in FIG. 12(*b*), when one RGB unit of the light emitting elements 11 such as LEDs corresponding to one pixel is disposed parted from each other, and there is enough space between adjacent RGB units, members constituting LED driving circuits 10 etc. are disposed to the space, so that the driving circuits can be disposed on the lighting element board. As described above, because the horizontal driving circuits can be downsized, the driving circuits 10 are disposed between pixels of the light emitting elements 11 and signal patterns between the horizontal driving circuit 3 are wired, so that these substrates, which are individual members previously, can be formed integrally. Wiring among the light elements 11 shown in FIG. 14 is pattern wiring in a mesh shape with vertical and horizontal direction. Due to reducing the number of signal lines between the horizontal driving circuits, the number of substrate design layers also can be reduced, so that cost of the substrate can be reduced.

Figure 13:
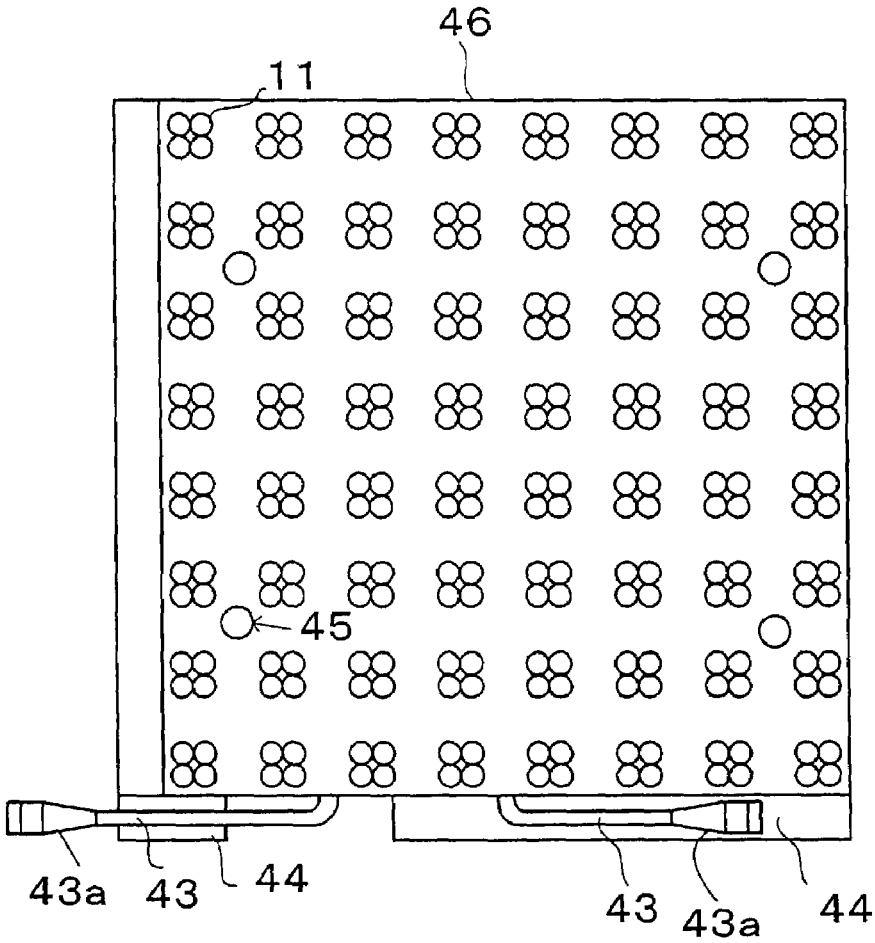
FIG. 13 is a front view showing another example of the driving circuit board.

Further, another embodiment formed with a lighting element board and a driving circuit board integrally is shown in FIG. 13. The integrated substrate 46 shown in this figure also constitutes one LED unit forming the lighting element board and the driving circuit board integrally. The integrated substrate 46 has a plurality of communication cables 43. In the FIGURE, two communication cables are disposed in the bottom, and have a male or a female connector 43*a* at end of them. The communication cable 43 connects with the adjacent integrated substrate 46 via the connectors 43*a*, and communicates with them. When only unidirectional communication is employed, one of the communication cables 43 can be set for input, and another communication cable 43 can be set for output.

In the embodiment of FIG. 13, 8 rows×8 columns units with four LEDs are disposed in a matrix shape. Each unit with two red LEDs, one green LED, and one blue LED constitutes one pixel. Further, each LED driving circuit is disposed on the back of LEDs disposing side, here back of the integrated substrate 46 in the figure. The integrated substrate 46 shown in this figure has penetrated holes 45 such as screw holes to fix.

The communication cable 43 is constituted by multiplex lines with a plurality of lead wires. A number of the signal lines can be set spontaneously, here the cable is constituted by two signal lines (data/strobe lines or a receiving clock line or the like) and two power source lines (for power supply and a ground wire) total four lines, for example. Accordingly, a configuration of the connector 43*a* of a terminal of the communication cable 43 can employ four pins, with small size. The constitution of the invention can reduce number of the signal lines extremely described above, so that the cable can be thin, also the connector can be small, and space-saving and cost reduction can be achieved.

The communication cables 43 are stored in a communication cable storing sections 44 respectively. The communication cables 43 can be pulled from the LEDs disposing surface side by the communication cable storing sections 44. In the constitution of the integrated substrate 46, the communication cable can be connected via connectors 43*a* with each other from front side in the figure without an operator connecting from backside of the integrated substrates disposing the LED drivers. Therefore, it is a merit that a connecting operation of the integrated substrate 46 can be easier with the constitution of connecting the integrated substrates each other by only the connectors of the cable synergically.

The communication cable storing sections 44 are formed with the substrate body in plastics integrally. Needless to say, the communication cable storing section can employ other constitutions properly. For example, a metal hook shape, an individual L-shaped plastic member can be employed, or the communication cable storing section can be omitted.

The display apparatus of this constitution can collocate a plurality of integrated substrate 46 by connecting the communication cable 43 of each integrated substrate 46, and can constitute a large-scale display easily. Each of the adjacent integrated substrates 46 is connected via connectors 43*a* each other, the integrated substrates positioned at both ends are with the driving control section.

Due to connecting the adjacent integrated substrates at left-right corresponding to disposition of the integrated substrates 46, or connecting the adjacent integrated substrates at upper-lower, connecting among the integrated substrates can cause the length of each of the communication cables 43 to be reduced. For example, when a plurality of the integrated substrates 46 are collocated in a horizontal direction to constitute a wide display, the integrated substrates 46 positioned in the middle are connected with the adjacent integrated substrates, both ends of the integrated substrates are connected with the driving control section, totally connected serially. Besides, to constitute a large-scale display by connecting in vertical and horizontal direction, in an rectangular shape, the integrated substrates 46 positioned in the middle are connected with the adjacent integrated substrates to the right and the left of each other, when they are connected up to end of a row, the integrated substrates 46 positioned at right or left end are connected with the adjacent integrated substrates to upper or lower, therefore the integrated substrates 46 positioned in the middle can be connected with the adjacent integrated substrates to right and left each other again in next row. Thus, connecting them one after another with turning at ends, the first and the last integrated substrates 46, i.e. the integrated substrates 46 positioned at two of vertexes, are connected with the driving control section, so that finally all of the integrated substrates 46 can be connected in serial. Besides, additionally the display can be constituted with the rectangular display described above rotated in 90 degrees, i.e. the integrated substrates 46 positioned in the middle can be connected to upper and lower, the integrated substrates 46 positioned at top or bottom can be connected with the adjacent integrated substrates to right or left, to constitute all of the integrated substrates are connected serially.

The driving control section transfers the control data to the integrated substrate 46 positioned at one of the ends, and receives the control data from the integrated substrate positioned at another end. Thus, the driving control section can perform data communication with the horizontal driving sections etc. connected serially and disposed on each integrated substrate 46 via a few signal lines. Further, this display can be used not only an image display, but also a luminance adjustable lighting to constitute a system controllable by an external control device.

Figure 15:
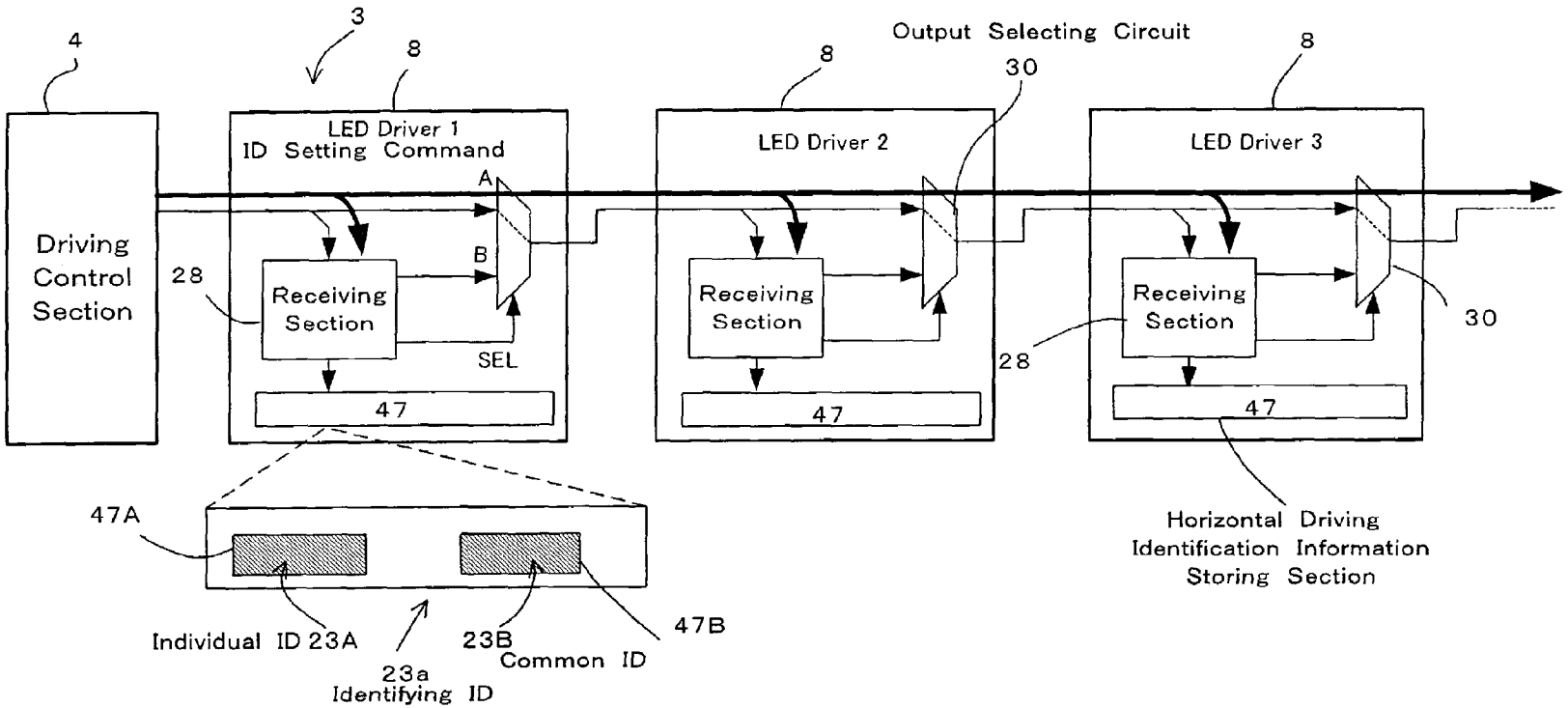
FIG. 15 is a block diagram showing a identification information setting status setting to horizontal driving sections.
Figure 16:
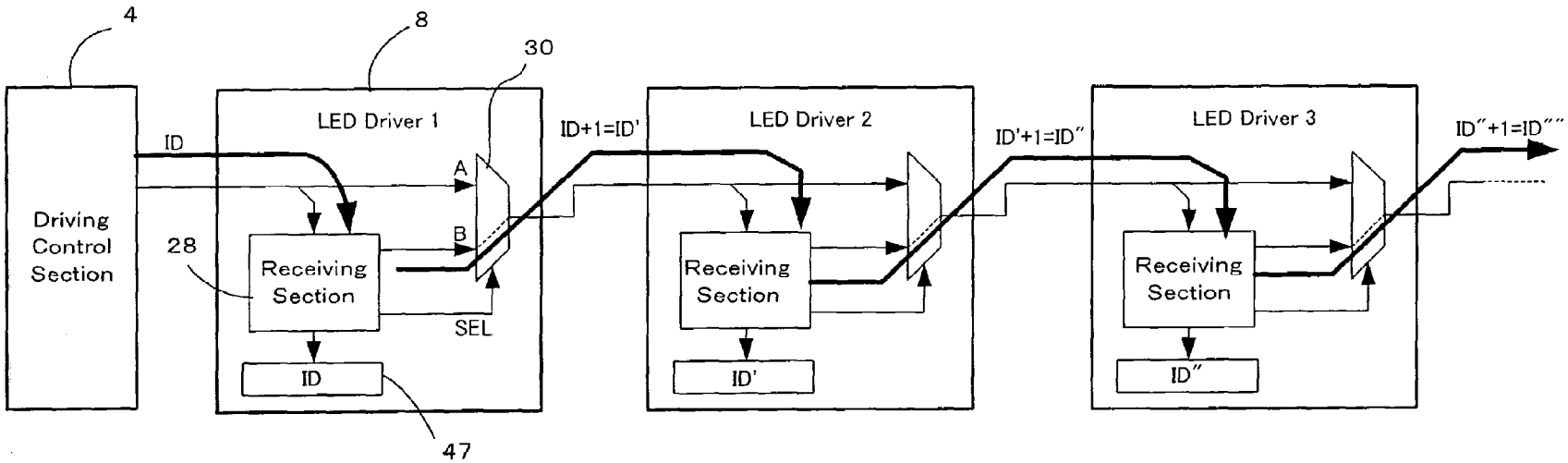
FIG. 16 is a block diagram showing a identifying allocating status allocating to horizontal driving sections.

FIG. 15 and FIG. 16 are schematic diagrams to explain a way to allocate the identification information to the horizontal driving sections 3. FIG. 15 shows a data transferring flow in a status that the driving control section 4 commands to add the identifying ID to each horizontal driving section 3. Further, FIG. 16 shows a data transferring flow in a status that the each horizontal driving section 3 stores the individual identification information ID 23*a* into the horizontal driving side information storing section 47 after the identification information adding command. To explain briefly, these figures show a case of three LED drivers 1–3, which are the horizontal driving sections 3.

The LED driver, which is the horizontal driving section, has the receiving section 28 and the horizontal driving side information storing section 47, and the output selecting circuit 30.

Each LED driver is connected serially, and performs data communication via the DMA control section 6A, which is the second communicating section 6 of the driving control section 4. The LED driver, which communicates with the driving control section 4 to perform horizontal driving of the LEDs, has the receiving section 28 to communicate according to common packet data format. In transferring data from the driving control section 4 to the horizontal driving section 3, the data transferred from the driving control section 4 side transferred via an input section of each horizontal driving section 3, and all data is transferred from an output section of each of the horizontal driving section 3 to the input section of the next horizontal driving section 3 transparently in an ordinary status as shown in FIG. 15. Further, as shown in FIG. 15 and FIG. 16, the output section of the horizontal driving section 3 has the output selecting circuit 30. The output selecting circuit 30 has an A-side input to transfer input data to the horizontal driving section 3 transparently, and a B-side input to perform data transmitting via the receiving section 28. The receiving section 28 connected with the output selecting circuit 30 controls to select the A-side input and the B-side input. The A-side input is selected ordinary, the data is transferred transparently against each horizontal driving section 3.

The receiving section 28 arranged in the horizontal driving section 3 is connected with the horizontal driving side information storing section 47 to store the identifying ID 23*a* identifying the horizontal driving section 3. The horizontal driving side information storing section 47 stores a plurality of the identifying IDs 23*a*. The circuit shown in FIG. 15 and FIG. 16 stores two kinds of the identification information. One of the identification information is the common identification information storing section 47B to store the common identification information to control all of the horizontal driving sections 3 commonly at the same time, and another identification information is the individual identification information storing section 47A to store the individual identification information to control each of the horizontal driving sections 3 individually. The common identification information is always stored not clear the storing contents by power ON/OFF operation. On the other hand, the individual identification information is stored in temporary storing memory, and set predetermined initializing value when powered ON or reset. As shown in FIG. 15, when the horizontal driving section 3 receives the command to add the identification information 23, the predetermined initializing value is stored in the individual identification information storing section 47A.

A procedure adding the individual identification information to each LED driver is described below. In FIG. 15, the driving control section 4 transfers the setting command of the identification information 23 to each horizontal driving section 3 in packet data form. At that time, the data is transferred with setting the identification information 23 inserted in the control field to the common identification information. The packet command is set the common identification information as the identification information 23 to control all of the driver ICs commonly, so that all of the horizontal driving sections 3 perform receiving process. Each horizontal driving section 3 discriminates this as the adding command of the identification information 23, and control the output selecting circuit 30 to select from the A-side input to the B-side input. Therefore, all of the output selecting circuits 30 select the B-side input.

FIG. 16 shows a status adding the individual identification information from the driving control section 4 to each LED driver one after another after receiving the packet command. After switching the output selecting circuit 30 from the A-side input to the B-side input, the receiving section 28 of the horizontal driving section 3 connected with the driving control section 4 directly is only the horizontal driving section positioned the nearest to the driving section 4, i.e. the receiving section 28 of an LED driver 1 in FIG. 16. Next, the driving control section 4 transfers an initial identification information to the horizontal driving section 3 positioned the nearest to the driving section 4. In FIG. 16, "ID" is transferred as the initial identification information. The initial identification information "ID" is stored in to the individual identification information storing section 47 A in the horizontal driving section 3 receiving it.

Further, after the horizontal driving section 3 receiving the initial identification information performs a predetermined calculating process to the initial identification information, then transfers to the next horizontal driving section 3. Each output selecting circuit 30 is set to the B-side, so that horizontal driving section 3, whose receiving section 28 is connected with the horizontal driving section 3 receiving the initial identification information directly, is only an LED driver 2. The LED driver 1 transfers a new identifying ID 23*a* to the receiving section 28 of the LED driver 2. The identifying ID 23*a* is performed the predetermined calculating process, and transferred as a identifying ID 23*a* different from the identifying ID 23*a* of the LED driver 1. For example, the calculating process is adding "1" to the received "ID" in FIG. 16. The calculating process can be performed in the output side of the LED driver 1 or in the input side of the LED driver 2. In addition, not only the adding process but also a subtracting process etc. can be employed.

"ID'(=ID+1)" is transferred from the B-side of the LED driver 1 to the LED driver 2. Then, after transferring, the LED driver 1 turns the output selecting circuit 30 from the B-side to the A-side input. The LED driver 2, which is the next horizontal driving section 3, stores the received calculated identifying "ID'" into the own individual identification information storing section 47A. Further, similarly as described above, after performing a similar calculating process to the received identifying ID 23*a*, it transfers to the LED driver 3, which is the next horizontal driving section 3, via the B-side of the output selecting section 30, then turns own output selecting circuit 30 to the A-side. Thus, the information transferring process is performed to the last horizontal driving section 3, then allocating the individual information is completed for all of the horizontal driving sections 3. After completing to add the individual information to all of the horizontal driving sections 3, all of the output selecting circuit 30 is turned to the A-side, therefore it is in ordinary packet receiving process status.

FIG. 21 and FIG. 22 show constitutions of connecting the horizontal driving sections 3 in the display device. The circuits shown in these figures dispose 4 rows×4 columns, total 16 horizontal driving sections 3 with disposing the driver IDs. Here, FIG. 21 shows the circuit connecting the horizontal driving sections 3 in a Z-shape, and FIG. 22 shows the circuit connecting the horizontal driving sections 3 in an S-shape.

In the driving circuit constitution with the Z-shaped connection of FIG. 21, it will be clearly understood with comparing these figures that a setting way of the identification information 23 (ID) agrees with the reading order of the image data, therefore the disposing order of the horizontal driving section 3 agrees with the adding order of the identification information 23 totally. In this constitution, the signal is transferred from left end to right end in the figure, and then requires to be transferred from left end again in the next row. Accordingly, when the horizontal driving section 3 disposed in one line of horizontal direction is connected with the horizontal driving section 3 in the next row, they are wired by the line with a distance corresponding to the width of the circuit in each row. Thus, as wiring is elongated, the reflecting deformation of the signal between terminals is increased.

On the other hand, in the S-shaped connection of FIG. 22, the signal transferred from left end to right end is transferred from the right end to the left end in the next row. In addition, the signal transferred at left end is transferred from the left end to the right end in a further next row. Thus, the signal is transferred in each row one after another, and then scanning is preformed in the whole vertical direction.

To achieve the constitution, the identification information 23 to be allocated to each horizontal driving section 3 is added not in order of disposing the horizontal driving sections 3, but with the S-shaped process to add toward reverse direction in the next row after transferred at the ends. In the circuit of FIG. 22, each horizontal driving section 3 is connected in the S-shape, so that the driving control section 4 can achieve the constitution described above with adding the identification information 23 in order of connecting the horizontal driving sections 3. Adding IDs can be performed by the way shown in FIG. 15 and FIG. 16.

In the horizontal driving sections 3 disposed from left to right in every row in FIG. 22, the first row is from left to right, i.e. the disposing order of the horizontal driving section 3 agrees with the identification information 23 similar to FIG. 21. It turns over as from right to left in the second row. In this figure, the driver 8, the driver 7, the driver 6, and the driver 5 are added "ID=5", "ID=6", "ID=7", and "ID=8" respectively. Further, in the next row, the third row, the identification information 23 is added from left to right similar to the first row. That is, in this row, the disposing order of the horizontal driving section 3 agrees with the identification information 23 again. In a further next row, the fourth row, it turns over as from right to left, and the back to the driving control section 4. By adding the identification information 23 to the horizontal driving sections 3 in this order, wiring between the horizontal driving sections 3 can be shortened, cause the wiring connects not with turning over to opposite side of the row but with the beneath horizontal driving section 3.

FIG. 17 shows a status of data transferring from the display control section 4 to each horizontal driving section 3 after the identification information 23 adding process. The display section of the display apparatus shown in this figure disposes 4×4 of horizontal driving sections 3 in a matrix shape further disposing 4×4 of LEDs in a matrix shape, and this figure shows 16×16 dot in a matrix shape, 256 pixels of LEDs of the display panel. The driving means, which have a constitution shown in FIG. 17, performs ¼ dynamic lighting driving with switching four times in one vertical period.

Each row of 1–16 LINE in the display section shown in FIG. 17 is connected with the decoder 16. The vertical driving section performs vertical driving with switching each LINE based on a common control address (ADR) input into the decoder and the lighting control signal (BLANK).

Disposing the horizontal driving section 3 shows a constitution that one IC, which constitutes the horizontal driving section 3 in the this embodiment, can controls 4×4 of LEDs. Accordingly, four horizontal driving sections 3 are required every LINE of the display section. In ¼ duty driving of the this embodiment, sixteen horizontal driving sections 3 are required. Further, in FIG. 17, the data is transferred to the horizontal driving section 3 by the display block 100, which is 4×4 area covered by each horizontal driving section 3.

Figure 18:
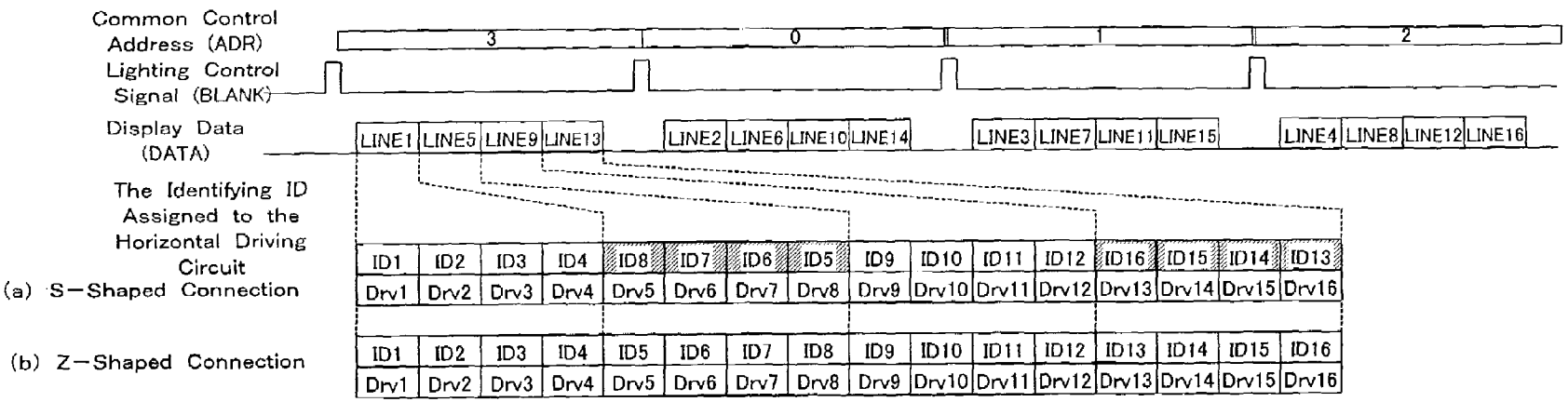
FIG. 18 is a timing chart showing a control information transferring status transmitting from a driving control section to display blocks of each row of a display section.

FIG. 18 shows an embodiment of controlling each horizontal driving section 3 in the circuit constitution of FIG. 17. Switching vertical line is performed by denoting address line 0–3 selected in the common address (ADR). Lighting operation is performed at the lighting control signal (BLANK) becoming LOW level. Accordingly, when one lighting vertical line is selected, it is required that transferring display data (DATA) is completed in the previous frame to the common control address. For example, LINE 1, 5, 9, 13 are connected with address line 0 of the common control address as shown in FIG. 17, when performing lighting operation of these line, the common control address is transferred not in "0", but in "3" previously.

The control data included in the display data includes control information to be transferred to each horizontal driving section 3 included in each LINE and the identification information 23 to denote transferring destination of the horizontal driving section 3. The interlacement of the control information and the identification information 23 depends on the connecting system of the circuit. For example, in the Z-shaped connecting circuit shown in FIG. 18(*b*), the data of driver 1 is transferred with interlacing to the identification information ID1 of the horizontal driving section. In this circuit constitution, the data is transferred according to an order of disposing the horizontal driving sections 3.

On the other hand, in the S-shaped connecting circuit shown in FIG. 18(*a*), control information is transferred according to an order of disposing the horizontal driving sections 3 in LINE 1 similar to (b). Besides, the data is transferred from right to left in LINE 5 as shown in FIG. 22, therefore is transferred in opposite direction, in descending direction such as from driver ICs 8–5, which are the horizontal driving sections 3, in the LINE. That is to say, the control information of driver 5, driver 6, driver 7, and driver 8 are allocated to identifying ID8, ID7, ID6, and ID5 respectively. In following LINE 9, the data is transferred from left to right in FIG. 22 similar to FIG. 18(*b*), accordingly the data is also allocated similar to FIG. 18(*b*). Further, in LINE 13, the data is transferred from right to left in FIG.

22, accordingly allocating the identification information 23 is changed. According to this way, even wiring circuits does not connect in order of one particular direction, only changing procedure of allocating the identification information to actual data can performs lighting control properly. Furthermore, even changing the circuit constitution, it has a merit that only changing the way, which the control circuit side allocates IDs to the appropriate data with adding proper IDs, can adapt it.

Figures 19, 20:
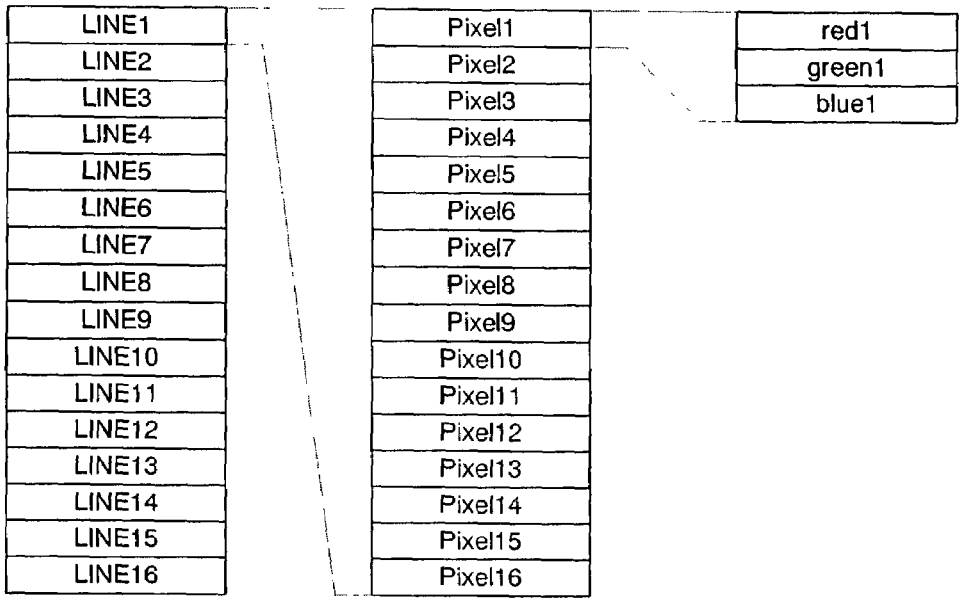
FIG. 19 is a schematic diagram showing a retaining status retaining identification information corresponding to each horizontal driving section in a memory section of a driving control section.
FIG. 20 is a schematic diagram showing image data allocating status allocating to display blocks of each row of a display section.

FIG. 19 shows how ID information is stored in the identification information storing section 25 arranged in the driving control section 4 to retain the individual ID 23A of each horizontal driving section 3. In this embodiment, the IDs are added in order of connecting drivers in the Z-shaped connecting circuit as shown in FIG. 19 (a). On the other hand, in the S-shaped connecting circuit shown in FIG. 19 (b), the adding IDs order turns over toward direction, from right to left in FIG. 22 at the driver 4 as described above, accordingly inverses order of disposing the horizontal driving sections 3 in driver 5–8. For example, as shown in FIG. 19 (a), the control information of driver 5, driver 6, driver 7, and driver 8 are allocated to identifying ID8, ID7, ID6, and ID5 respectively. In following LINE 9, the data is transferred from left to right in FIG. 22 similar to FIG. 19 (b), accordingly the data is also allocated similar to FIG. 19 (*b*). Further, in LINE 13, the data is transferred from right to left in FIG. 22, accordingly allocating the identification information 23 is changed. Thus in a hatched section in FIG. 19 (a), adding IDs order is constituted with deferent from Z-shaped type.

In the case of the Z-shaped circuit, in the operation of each line, order of adding the identification information 23 is same as the order of disposing the horizontal driving sections 3, therefore the horizontal driving section number agrees with the identification information ID number in the embodiment of FIG. 19 (b). On the other hand, in the case of the S-shaped circuit shown in FIG. 19 (*a*), the order of adding IDs inverses at even number lines. In the driving circuit of the invention, even disposing the horizontal driving sections 3 or the connecting constitution are changed, it is not required to change the way to read the image data.

FIG. 20 shows a status allocating the control data for image display to the memory section 17 of the driving section 4. In this embodiment, the image data to be displayed is written to the 16 rows×16 columns of the dot matrix display. The driving control section 4 retains 16 rows (LINE 1–16) of data, the data relating to 16 columns of pixels connected with the row is stored by each row. For example, the data of pixels 1–16 (Pixel 1–16) is retained in first row in the figure. Further, when displaying in full-color, three colors, RGB, of the data is retained in each pixel.

FIG. 21 and FIG. 22 show examples of constitution connecting the horizontal driving sections 3 in the display device. FIG. 21 shows a constitution connecting the horizontal driving sections 3 in Z-shape. In the figure, headmost of the driver IC in each row constituting the horizontal driving section 3 is connected first, aftermost of the driver IC is connected with the input of headmost of the driver IC in next row. This connecting constitution has a demerit to increase reflecting deformation of the signal among the terminals according to elongating the wire, when each of the driver ICs disposed in one horizontal line is connected with the driver IC in a next line.

On the other hand, FIG. 22 shows a constitution connecting in S-shape. The output of aftermost of the driver IC in each row is connected with the input of driver IC positioned the closest to it, end of the driver IC in next row. Thus, the connecting constitution has a feature that aftermost of the driver IC in each row is connected with the end of the driver IC in next row by the shortest pattern, therefore deformation of the signal can be reduced to a minimum.

Difference of ID adding ways between two kinds of the ways connecting the driver ICs shown in FIG. 21 and FIG. 22 is described below. Z-shaped connecting of FIG. 21 has a feature that the ID number is added from left end driver IC to right end driver IC in ascending order. Ordinary, the control data such as the image data is stored in the storing section in the driving control section 4 in this order, the data in the data storing section is read sequentially, and is transferred to the driver ICs. Further, in Z-shaped connecting, the data is read ID number retained in the ID resister, which is the identification information storing section 25 of the driving control section 4, from ID1 to ID 16 in ascending order. Thus, the data packets including the data read from the data storing section can be added with the IDs, and transferred.

On the other hand, in S-shaped connecting of FIG. 22, when data reading procedure employs the way similar to Z-shaped connecting, ID number is registered into the ID register as shown in FIG. 19 (b). Although ID1–ID 16 are set in ascending order in Z-shaped connecting, in S-shaped connecting, the ID number in turnover rows is set in descending order.

Thus, accordingly the ID number setting way to the identification information storing section 25 is set corresponding to connecting form of the horizontal driving sections 3, the image data etc, is transferred to each horizontal driving section 3 properly without changing the image data reading way.

Figure 23:
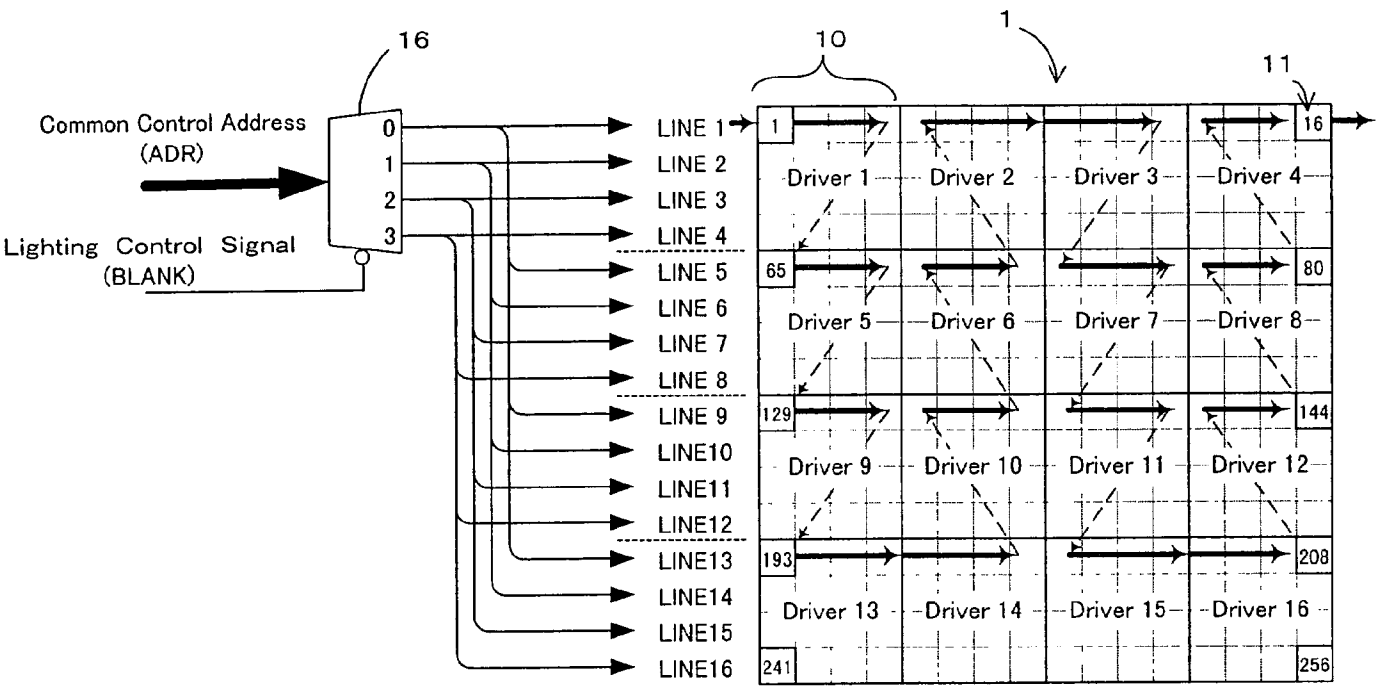
FIG. 23 is a schematic diagram showing another example of a connecting status connecting a vertical driving section with display blocks of each row of a display section.

Further, FIG. 23 shows a display apparatus of another embodiment of the invention. In the display block 100 in the display section 1 shown in this figure, i.e. the example of connecting the horizontal driving sections 3, the driver ICs are connected with the vertically adjacent driver ICs, the driver ICs positioned at top and bottom are further connected with the adjacent driver ICs in a next column. That is to say, it is a status such that the connecting system of FIG. 17 is rotated 90 degrees.

Each of LINE 1–16 of the display section 1 shown in FIG. 23 is also connected with the decoder 16, the driving control section 4 performs vertical driving based on the common control address (ADR) input into the decoder 16 and the lighting control signal (BLANK) with switching each of LINE. The data corresponding to the horizontal driving section 3 is transferred to the horizontal driving sections 3 by 4×4 dot area covered by each horizontal driving section 3 as one unit.

FIG. 23 shows a status transferring the data corresponding to LINE 1, 5, 9, 13 connected with the address line "ADR=0" of the common control address, for example. Accordingly the horizontal driving section 3 covering each display block 100 is connected with upper and lower, the data is transferred in direction from upper to lower, such as from LINE 1 of driver N=1, LINE 5 of driver N=5, LINE 9 of driver N=9, to LINE 13 of driver N=13 one after another. Further, the direction is inversed from lower to upper in next column, the data is transferred LINE 13 of driver N=14, LINE 9 of driver N=10 one after another In addition, the direction is from upper toward lower again in following third columns, furthermore inversed from lower to upper. Thus, the data is transferred in zigzag one after another. This way can also wire among the driver ICs the shortest, so that has a merit similar to the embodiment of foregoing FIG. 17.

Besides, in the embodiments described above, the display unit is shown as a matrix display disposing a plurality of pixels with LEDs, which are lighting device, the display unit can be constituted with disposing lighting elements corresponding to at least of one pixel. The lighting element can employ a liquid crystal, an EL device, a PDP, an electric bulb or the like. Further, a neon tube etc. can be employed as the lighting element, gradation of lighting intensity is employed as the display data.

The display apparatus of the invention has a feature to reduce a number of signal lines of the circuit driving the display section disposing a plurality of the lighting devices, and to simplify wiring for low-cost and downsizing. Accordingly the invention has a driving control section to communicate with each horizontal driving section, wiring each horizontal driving section can be simplified.

Especially, according to high-luminance, high-definition, required data amount is increased. Increasing pixel number, high-density are required, further RGB three colors is necessary for in full-color, so that three times information amount, signal lines are required. According to the invention, necessary signal line number can be reduced extremely, producing cost can be reduced by downsizing with reducing wiring space or simplifying wiring process.

Especially, the invention controls the horizontal driving sections individually or commonly by control signals between the second communicating section and the horizontal driving sections in the display apparatus formatted in packet format. Packet communication can transfer various data by common wiring, so that it is not necessary to dispose signal lines for each of the control signals. Further, the communication data is retained in the memory of the horizontal driving section temporary, so that various data can be transferred in predetermined order. Adding type of the data, destination information to the transferred data, various data can be transferred by a same interface. Further, individual control of each horizontal driving section can be commanded. Thus, communication is performed by common lines to communicate among the sections without wiring individual lines, so that signal line number can be reduced extremely, and data lines can be minimized.

Further, in the invention, the reference clock can be generated autonomously, so that the gradation clock can be backed up, or even the gradation reference clock can be omitted. The display apparatus of this constitution can reduce wiring number, so that reflection of the signal cause of elongating wires, generating noise can be reduced. Furthermore, pin number of the interface of the horizontal driving section can be reduced extremely, so that it contributes shrink of a whole IC package, reduces component size and number, and furthermore simplifies process such as wiring etc. can reduce producing cost.

Further, the display apparatus of the invention has the driving circuit board with the light emitting device substrate disposing the light emitting device and the driving circuit of the light emitting device integrally. According to difficulty to retain a space for the light emitting device and the driving circuit on one substrate in a prior substrate wiring for numbers of signal lines, it has these discrete substrates individually. To connect the individual substrates with layers, the multi-layers make the apparatus thick and prevent its downsize. Accordingly, the invention reduces the signal line number, especially in the display apparatus with a light emitting device disposed distantly, the driver ICs, which is the driving circuit, can be disposed in the space, so that the apparatus can be constituted on one substrate. The invention of this structure can reduce the substrate layer number, therefore it can thin the apparatus.

Furthermore, the display apparatus of the invention can dispose the driving apparatus of the display device to be independent from data transferring order, therefore can constitute the circuit flexibly independently, so that can simplify wiring, reduce a producing cost, reduce noise and so on. That is, the way of connecting the horizontal driving sections is not required to fix univocally.

The display apparatus of the invention has the communicating section, which can communicate data with the horizontal driving sections in a common system, signal lines. Therefore, the display apparatus of the invention can adapt to change disposing the driving section and connecting form in the display device with defining various control data form transferred from the driving control section to the horizontal driving sections with independent from difference of the driving system of the display device. In addition, it is not required to transfer data in signal line connecting order by denoting destination of the transferred data, so that the display apparatus of the invention can connect the horizontal driving section relatively in flexible. Accordingly the display apparatus of the invention can connect the signal lines between the driver ICs not only in monotonous one direction but also relatively in flexible, so that it has many merits such that to simplify wiring the signal lines, to shorten total length of the signal lines, or the like.

According to the invention, for example, it is not necessary to dispose the horizontal driving sections in Z-shape and to wire to transfer data in one direction invariably. In the Z-shaped circuit constitution, when transferred to one end, the signal is transferred back to another end of next row. On the other hand, for example, connecting the horizontal driving sections adjacent at end in vertical direction in S-shape can wire in shortest length. Therefore, total length of the packet signal line can be shortened extremely. Shortening signal lines can not only simplify circuit designing, but also simplify signal pattern mounting circuit on the printed substrate, a driving circuit manufacturing process, and cost reduction. In addition, it can avoid noise and deformation of the signal cause of elongating, and simplify a special process such as a noise reduction or signal amplifying.

Further, even when the circuit constitution is changed the connecting system of the horizontal driving sections, it is not required to change the constitution of the driving control side transferring data to the driving circuits. That is, according to the difference of horizontal driving section disposition or connecting order, the driving control section side can change destination of the data transferred to them. The driving control section can add the individual identification information to each horizontal driving section, and transfer the control data with adding the identification information to it, therefore receiver side can discriminate the identification information whether the data is for itself or not. Accordingly the driving control section side changes relation between the identification information and the corresponding data, the data can be transferred properly even in the driving circuits with deferent circuit constitutions. Thus, it has the feature to adapt flexibly without reconstructing a dedicated control section, according to changing the constitution of the driving circuit.

Furthermore, the display apparatus of the invention has a feature to set the identifying IDs added to each horizontal driving section from the driving control section automatically. Therefore, even the constitution of the driving circuits is changed, it has a merit to use only with an initial setting of the identifying IDs without changing the hardware.

INDUSTRIAL APPLICABILITY

As described above, the display apparatus of the invention can adapt various applications flexibly. For example, the LED display as the display apparatus can be used in a large-scale television, a billboard, an advertisement, traffic information, a three-dimensional display device, a lighting and so on. Especially, it optimizes downsizing, low cost, automatizing and high design flexibility for the apparatus.

The invention claimed is:

1. A display apparatus comprising:

a display section having a plurality of lighting elements;

a vertical driving section operable to drive each row of the display section selectively;

a plurality of horizontal driving sections, wherein each of the horizontal driving sections has a horizontal driving communicating section communicating various control data, and wherein the horizontal driving sections control lighting gradation based on the various control data by selecting the lighting elements of desired columns in a row selected by the vertical driving section; and a driving control section having a first communicating section operable to communicate the various control data with an external device, and a second communicating section connected with a plurality of the horizontal driving sections serially, wherein the driving control section controls the vertical driving section and the horizontal driving sections, wherein:

the second communicating section transfers data packets having a control field including identification information, which is an ID to denote the horizontal driving sections to be transferred the various control data, control identification information to denote a type of the control data, and an information field including the control data to the horizontal driving sections; and the horizontal driving communicating section receives the control data for the horizontal driving section, when the ID of identification information of the transferred data packet agrees with ID stored in itself.

2. The display apparatus according to claim 1, wherein each of the horizontal driving sections stores a common ID to be received commonly for all of the horizontal sections and the individual ID added individually to each of the horizontal sections as identification information to judge whether to perform a receiving process for the transferred data packet.

3. The display apparatus according to claim 1, wherein each of the horizontal driving communicating sections has a receiving section performing a receiving process, and an output selecting circuit outputting the various control data input into the horizontal driving communicating section and data input from the receiving section selectively, outputs a control field of an input data packet transparently from the output selecting circuit, and outputs an information field with replacing for a predetermined data packet.

4. The display apparatus according to claim 3, wherein:

the predetermined data packet is a disturbance data reading packet having the identification information, the control field including control identification information denoting to read a disturbance data, and the information field including dummy data;

each of the horizontal driving communicating sections further has a disturbance data retaining section retaining the disturbance data and outputs the disturbance data retained in the disturbance data retaining section with replacing dummy data included in the control field of the disturbance data reading packet received in the receiving section of the horizontal driving section with switching the output selecting circuit, when the identification information of the data packet received in the receiving section of the horizontal driving section agrees with its own individual ID and has the control identification information denoting control type to read a disturbance data; and the driving control section reads the disturbance data of the disturbance reading packet transferred from the horizontal driving section.

5. The display apparatus according to claim 3, wherein:

the predetermined data packet is a communication check packet having the identification information, the control field including control identification information denoting a communication check, and the information field including a communication check data;

each of the horizontal driving communicating sections further has a data reversing section reversing data of the information field, and outputs data from the data reversing section with replacing the communication check data included in the information field of the communication check packet received in the receiving section of the horizontal driving section with switching the output selecting circuit, when the identification information of the data packet received in the receiving section of the horizontal driving section agrees with its own individual ID and has the control identification information denoting a control type of the communication check; and the driving control section performs a disturbance check of a communication statement based on the data included in the information field of each communication check packet replied from each horizontal driving section and the communication check data of the communication check packet transferred to each horizontal driving section.

6. The display apparatus according to claim 4, wherein:

each of the horizontal driving sections has a third counter counting input of a first reference clock and retaining predetermined data when a count number of the input first reference data becomes a predetermined value, and clearing the count number of the first reference clock when the horizontal driving communicating section receives a frame start packet denoting frame synchronizing;

the disturbance data retaining section retains data denoting an occurrence of a disturbance of the first reference clock, when a count number of the third counter is less than the predetermined value; and the driving control section reads the data denoting an occurrence of disturbance of the first reference clock by the disturbance data reading packet, controls the reference clock selecting circuit of the horizontal driving section occurring the disturbance to select from the first reference clock to the second reference clock by the data packet.

7. The display apparatus according to claim 6, wherein the predetermined value of the count number of the first reference clock is set based on indicating a gradation number of one frame.

8. The display apparatus according to claim 1, wherein:

the horizontal driving communicating section of each of the horizontal driving sections can output only in one direction; and the output data from the horizontal driving communicating section connected at an end position of the lowest stream in a data transferring direction in a plurality of the horizontal driving sections connected serially is input to the second communicating section of the driving control section.

9. The display apparatus according to claim 1, wherein:

the driving control section or the horizontal driving section has a first reference clock generating section generating a first reference clock to control lighting gradation; and each of the horizontal driving sections further has a lighting control section controlling lighting gradation based on a reference clock, a second reference clock generating section generating a second reference clock synchronizing the various control data input from the driving control section, a reference clock selecting circuit, to which is input the first reference clock and the second reference clock, and selects the first reference clock or the second reference clock alternatively to output as the reference clock to control lighting gradation.

10. The display apparatus according to claim 9, wherein:

each of the horizontal driving sections further has a first counter counting an input of the first reference clock and generating a clear signal every predetermined count number;

a second counter counting an input of the second reference clock until being input the clear signal from the first counter; and the reference clock selecting circuit selects the reference clock from the first reference clock to the second reference clock, when a count number of the second counter becomes higher than a predetermined value.

11. The display apparatus according to claim 1, further comprising:

a substrate integrated with a lighting element board disposing the lighting elements and a driving circuit board having driving circuits driving the lighting elements, and wherein the driving circuits are disposed between the lighting elements.

12. The display apparatus according to claim 1, wherein a plurality of the lighting elements are disposed in a matrix shape in the display section.

13. The display apparatus according to claim 1, wherein the control data is image data for image-displaying.

14. The display apparatus according to claim 1, wherein the control data is illuminating data for an illumination.

15. A display apparatus comprising:

a display section having a plurality of lighting elements;

a vertical driving section operable to drive each row of the display section selectively;

a plurality of horizontal driving sections, wherein each of the horizontal driving sections has a horizontal driving communicating section communicating various control data, and wherein the horizontal driving sections control lighting gradation based on the various control data by selecting the lighting elements of desired columns in a row selected by the vertical driving section; and a driving control section having a first communicating section operable to communicate the various data with an external device, and a second communicating section connected with a plurality of the horizontal driving sections serially, wherein the driving control section controls the vertical driving section and the horizontal driving sections, wherein:

the horizontal driving sections are connected to each other by signal lines and can communicate the data with the driving control section;

the driving control section adds identification information to transferred control data to each horizontal driving section corresponding to a connecting formation of the horizontal driving sections in the display section and transfers various control data;

the horizontal driving sections perform a lighting control of the lighting elements;

the second communicating section transfers data packets having a control field including identification information, which is an ID to denote the horizontal driving sections to be transferred the various control data, control identification information to denote a type of the control data, and an information field including the control data to the horizontal driving sections; and the horizontal driving communicating section receives the control data for the horizontal driving section, when the ID of identification information of the transferred data packet agrees with ID stored in itself.

16. The display apparatus according to claim 15, wherein:

the driving control section further has an identification information storing section storing IDs added to the horizontal driving sections according to an order to transfer the control data to the horizontal driving sections corresponding to a path of the signal lines connecting the horizontal driving sections to each other; and the driving control section transfers the control data input from the external device with adding the IDs read from the identification information storing section corresponding to each horizontal driving section one after another to the horizontal driving sections in data packet format.

17. The display apparatus according to claim 15, wherein:

the display section is constituted by a plurality of indicating blocks divided into m rows×n columns, wherein m, n are integers and two or more areas;

the horizontal driving sections are connected from the second communicating section side one after another in a horizontal direction serially; and the horizontal driving section connected at an end column of the lowest stream in each row is connected with the horizontal driving section of a same column in a next row.

18. The display apparatus according to claim 15, wherein:

each of the horizontal driving sections judges whether to perform a receiving process against the transferred data packets based on the identification information added to the data packets or not, by storing an individual ID, which is added to each horizontal driving section individually, to the horizontal driving side identification information storing section; and the horizontal driving sections store a common ID to be received by all of the horizontal driving sections commonly.

19. A display apparatus comprising:

a display section having a plurality of lighting elements;

a vertical driving section driving each row of the display section selectively;

a plurality of horizontal driving sections, wherein each of the horizontal driving sections has a horizontal driving communicating section communicating various control data, and wherein the horizontal driving sections control lighting gradation based on the various control data by selecting the lighting elements of desired columns in a row selected by the vertical driving section; and a driving control section having a first communicating section operable to communicate the various data with an external device, and a second communicating section connected with a plurality of the horizontal driving sections serially, wherein the driving control section controls the vertical driving section and the horizontal driving sections, wherein:

each of the horizontal driving communicating sections of the horizontal driving sections has a horizontal driving side identification information storing section storing identifying ID denoting an ID of the horizontal driving section;

the identifying ID of each of the horizontal driving sections stored in the horizontal driving side identification information storing section is set to different identifying IDs from the horizontal driving section connected with the second communicating section side one after another based on a predetermined calculation;

the second communicating section transfers data packets having a control field including identification information, which is an ID to denote the horizontal driving sections to be transferred the various control data control identification information to denote a type of the control data and an information field including the control data to the horizontal driving sections; and the horizontal driving communicating section receives the control data for the horizontal driving section when the ID of identification information of the transferred data packet agrees with ID stored in itself.

20. The display apparatus according to claim 19, wherein:

each of the horizontal driving communicating sections of the horizontal driving sections has a receiving section for inputting and outputting data, an output selecting circuit outputting data input to the horizontal driving section or the data output from the receiving section selectively;

when setting a command to set the ID of the horizontal driving section is input, the horizontal driving communicating sections control to switch the data output of the output selecting circuit from the data input to the horizontal driving section to the data output through the receiving section; and to store the identifying ID input to the receiving section to the horizontal driving side identification information storing section and to output an identifying ID, which is performed the predetermined calculation against the identifying ID input to the receiving section from the output selecting circuit.

21. The display apparatus according to claim 19, wherein:

the horizontal driving communicating sections of the horizontal driving sections have a receiving section for inputting and outputting data, an output selecting circuit outputting data input to the horizontal driving section or the data output from the receiving section selectively;

when setting a command to set the ID of the horizontal driving section is input, the horizontal driving communicating sections controls to switch the data output of the output selecting circuit from the data input to the horizontal driving section to the data output through the receiving section; and to store the identifying ID, which is performed the predetermined calculation against the identifying ID input to the receiving section, to the horizontal driving side identification information storing section and to the identifying ID performed the predetermined calculation from the output selecting circuit.

22. The display apparatus according to claim 19, wherein the horizontal driving communicating sections of the horizontal driving sections control to switch the data output of the output selecting circuit from the data through the receiving section to the data input to the horizontal driving section after outputting the identifying ID performed the predetermined calculation from the output selecting circuit.

23. A display driving circuit driving a display apparatus, which has a display section having a plurality of lighting elements, comprising:

a vertical driving section driving each row of the display section selectively;

a plurality of horizontal driving sections, wherein each of the horizontal driving sections has a horizontal driving communicating section communicating lighting data for lighting the lighting elements, performing light-driving based on the lighting data by selecting the lighting elements of desired columns in a row selected by the vertical driving section; and a driving control section having a first communicating section operable to communicate the lighting data with an external device, and a second communicating section connected with a plurality of the horizontal driving sections serially, wherein the driving control section controls the vertical driving section and the horizontal driving sections, wherein:

the horizontal driving sections have added IDs to discriminate themselves;

the second communicating section transfers data packets having a control field including identification information, which is the ID to discriminate the horizontal driving section to be transferred the lighting data, and control identification information to denote a type of the lighting data, and an information field including the lighting data to the horizontal driving sections; and the horizontal driving communicating sections receive the lighting data for the horizontal driving sections, when the ID of identification information of the transferred data packet agrees with ID added to itself.

24. A display driving circuit driving a display apparatus, which has a display section having a plurality of lighting elements and a vertical driving section driving each row of the display section selectively, comprising:

a plurality of horizontal driving sections, wherein each of the horizontal driving sections has a horizontal driving communicating section communicating lighting data for lighting the lighting elements, performing light-driving based on the lighting data by selecting the lighting elements of desired columns in a row selected by the vertical driving section; and a driving control section having a first communicating section operable to communicate the lighting data with an external device, and a second communicating section connected with a plurality of the horizontal driving sections serially, wherein the driving control section controls the vertical driving section and the horizontal driving sections, wherein:

the horizontal driving sections have added IDs to discriminate themselves;

the second communicating section transfers data packets having a control field including identification information, which is the ID to discriminate the horizontal driving sections to be transferred the lighting data, and control identification information to denote a type of the lighting data, and an information field including the lighting data to the horizontal driving sections; and the horizontal driving communicating sections receive the lighting data for the horizontal driving sections, when the ID of identification information of the transferred data packet agrees with ID added to itself.

25. A display driving circuit driving a display apparatus, which has a display section having a plurality of lighting elements, a vertical driving section driving each row of the display section selectively, and a plurality of horizontal driving sections each having a horizontal driving communicating section communicating lighting data for lighting the lighting elements, performing light-driving based on the lighting data by selecting the lighting elements of desired columns in a row selected by the vertical driving section, comprising:

a driving control section having a first communicating section operable to communicate the lighting data with an external device, and a second communicating section connected with a plurality of the horizontal driving sections serially, wherein the driving control section controls the vertical driving section and the horizontal driving sections, wherein:

the horizontal driving sections have added IDs to discriminate themselves;

the second communicating section transfers data packets having a control field including identification information, which is the ID to discriminate the horizontal driving sections to be transferred the lighting data, and control identification information to denote a type of the lighting data, and an information field including the lighting data to the horizontal driving sections; and the horizontal driving communicating section receives the lighting data for the horizontal driving sections, when the ID of identification information of the transferred data packet agrees with ID added to itself.

26. A method for driving a display apparatus, which has a display section having a plurality of lighting elements, a vertical driving section driving each row of the display section selectively, and a plurality of horizontal driving sections, wherein each of the horizontal driving section has a horizontal driving communicating section communicating lighting data for lighting the lighting elements and performing light-driving based on the lighting data by selecting the lighting elements of desired columns in a row selected by the vertical driving section, wherein the horizontal driving sections are connected to each other by a signal line and can communicate the data with a driving control section, comprising:

storing, by the driving control section, IDs added to the horizontal driving section corresponding to a path of the signal line connecting the horizontal driving sections to each other;

adding, by the driving control section, IDs identifying the horizontal driving sections to the horizontal driving sections;

transferring, by the driving control section, the lighting data input from an external device with adding the stored IDs corresponding to each horizontal driving section one after another to the horizontal driving sections in data packet format, wherein the data packet has a control field including identification information, which is an ID to denote the horizontal driving sections to be transferred the various control data, control identification information to denote a type of the control data, and an information field including the control data to the horizontal driving sections; and receiving, by the horizontal driving sections, the data packet for itself, performing a predetermined process, and then transferring the data to the horizontal driving section connected next or the driving control section.

27. A driving circuit of an image display apparatus comprising:

a display section having a plurality of lighting elements in a matrix shape;

a vertical driving section driving each row of the display section selectively;

a plurality of horizontal driving sections, wherein each of the horizontal driving sections has a horizontal driving communicating section communicating various control data including image data, and wherein the horizontal driving sections control lighting gradation based on the various control data by selecting the lighting elements of desired columns in a row selected by the vertical driving section;

a driving control section having a first communicating section operable to communicate the various data with an external device, and a second communicating section connected with a plurality of the horizontal driving sections serially, wherein the driving control section controls the vertical driving section and the horizontal driving sections;

wherein the second communicating section transfers data packets having a control field including identification information, which is the ID to denote the horizontal driving sections to be transferred the various control data, and control identification information to denote a type of the control data, and an information field including the control data to the horizontal driving sections, and wherein the horizontal driving communicating section receives the control data for the horizontal driving sections, when the ID of identification information of the transferred data packet agrees with ID stored therein.

28. A driving circuit of an image display apparatus comprising:

a display section having a plurality of lighting elements in a matrix shape;

a vertical driving section driving each row of the display section selectively;

a plurality of horizontal driving sections, wherein each of the horizontal driving sections has a horizontal driving communicating section communicating various control data including image data, and wherein the horizontal driving sections control lighting gradation based on the various control data by selecting the lighting elements of desired columns in a row selected by the vertical driving section;

a driving control section having a first communicating section operable to communicate the various data with an external device, and a second communicating section connected with a plurality of the horizontal driving sections serially, wherein the driving control section controls the vertical driving section and the horizontal driving sections, wherein the horizontal driving sections are connected to each other by a signal line and can communicate the data with the driving control section, wherein the driving control section adds identification information to transferred control data to each horizontal driving section corresponding to a connecting formation of the horizontal driving sections in the display section and transfers the various control data, wherein the horizontal driving sections perform lighting control of the lighting elements, wherein the driving control section further has an identification information storing section storing IDs added to the horizontal driving section according to an order to transfer the control data to the horizontal driving section corresponding to a path of the signal line connecting the horizontal driving sections to each other, wherein the driving control section transfers the control data input from the external device with adding the IDs read from the identification information storing section corresponding to each horizontal driving section one after another to the horizontal driving sections in data packet format, and wherein the data packet has a control field including identification information, which is an ID to denote the horizontal driving sections to be transferred the various control data, control identification information to denote a type of the control data, and an information field including the control data to the horizontal driving sections.

* * * * *